US006854725B2

(12) United States Patent
Kobayashi

(10) Patent No.: US 6,854,725 B2
(45) Date of Patent: Feb. 15, 2005

(54) SEPARATING ARM HOLDING MECHANISM

(75) Inventor: Hideaki Kobayashi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/651,100

(22) Filed: Aug. 29, 2003

(65) Prior Publication Data

US 2004/0041336 A1 Mar. 4, 2004

(30) Foreign Application Priority Data

Aug. 30, 2002 (JP) ..... P2002-254446

(51) Int. Cl.[7] ..... B65H 3/54
(52) U.S. Cl. ..... 271/170
(58) Field of Search ..... 271/170; B65H 3/54

(56) References Cited

U.S. PATENT DOCUMENTS 4,828,245 A * 5/1989 Shimogawara ..... 271/171
5,096,182 A * 3/1992 Kashimura ..... 271/170
5,443,251 A * 8/1995 Kan et al. ..... 271/16
5,992,843 A * 11/1999 Lee ..... 271/170
6,634,638 B2 * 10/2003 Toda et al. ..... 271/162

FOREIGN PATENT DOCUMENTS

JP 58-2145 * 1/1983 ..... B65H/3/56

* cited by examiner

*Primary Examiner*—Donald P. Walsh
*Assistant Examiner*—Kenneth W Bower
(74) *Attorney, Agent, or Firm*—Birch, Stewart, Kolasch & Birch, LLP

(57) ABSTRACT

After a separating arm is rotated forward so that a plate axis of an attachment plate is inserted into a hole and an insertion slit of the separating arm, in a state that the insertion slit faces an arresting slit, the separating arm is rotated reverse while a portion in the periphery of the hole that faces the portion at which the insertion slit is formed is kept pressed against an end portion of the plate axis, so that a portion in the periphery of the hole other than the portion at which the insertion slit is formed is fit into the arresting slit.

5 Claims, 20 Drawing Sheets

SEPARATING ARM HOLDING MECHANISM

BACKGROUND OF THE INVENTION

The present invention relates to improvement of paper sheet feeders for use in image forming apparatuses such as copying machines, printers, and facsimile devices, and more particularly relates to an improvement of a separating arm holding mechanism in a sheet feeder utilizing a corner pawl separation method.

A sheet feeder for use in image forming apparatuses feeds paper sheets, sheet by sheet, by separating an uppermost sheet from a sheet stack housed in a feed tray. For such sheet feeding, as a sheet feeder for separating sheets constituting a sheet stack, sheet by sheet, there has conventionally been a sheet feeder of a separating arm method in which corner pawls are brought into contact with the top face at both end corner portions of each sheet on the downstream side of its feeding direction. The sheet feeder of this separating arm method is so structured that, as shown in FIG. 8, inside a rectangular casing tray 1 with an upper face opened, a separating arm 104 with a corner pawl 104*a* formed at its end portion is supported by an attachment plate 103 that is in contact with both side ends of a sheet stack 2 to regulate the sheet width.

A portion of the sheet stack 2 on the downstream side with respect to its feeding direction (hereinafter, referred to as a front portion of the sheet stack 2) is lifted from a bottom plate of the tray 1 by elasticity of an elastic member such as springs through an unshown lift plate, so that the top face of the uppermost sheet is normally in contact with the corner pawl 104*a* regardless of the volume of the sheet stack 2. Above the front portion of the sheet stack 2, an unshown semicircular feed roller is disposed so as to be rotatable. During feeding operation, the feed roller rotates so as to move a sheet to the downstream side of the feeding direction, while pressing down the entire sheet stack 2 against the elasticity of the elastic member to keep tight contact with the top face of the uppermost sheet of the sheet stack 2. In this operation, since the uppermost sheet of the sheet stack 2 is restrained from moving to the downstream side of its feeding direction by the corner pawl 104*a*, sagging occurs on the portion of the uppermost sheet on the downstream side in its feeding direction, as a consequence of which a resilience due to the sagging makes the sheet's both end corner portions on the downstream side in the feeding direction overpass the corner pawl 104*a*. This enables feeding of only the uppermost sheet of the sheet stack 2.

The separating arm 104 having the corner pawl 104*a* is supported by the attachment plate 103 so that the corner pawl 104*a* comes into contact with the top face of the uppermost sheet in the sheet stack 2 at an appropriate pressure in conformity with displacement of the top face of the uppermost sheet even when the entire sheet stack 2 is pushed down by rotation of the feed roller. More specifically, as shown in FIG. 9, the separating arm 104 having the corner pawl 104*a* is swingably supported at three points: a central swing-center support portion 105; an anterior swing guide portion 106; and a posterior swing guide portion 108, each formed on the attachment plate 103. These central swing-center support portion 105, the anterior swing guide portion 106 and the posterior swing guide portion 108 constitute a separating arm holding mechanism.

When the top face of the uppermost sheet is displaced downward by rotation of the feed roller, the rotation moment by its own weight is generated on the separating arm 104 around the central swing-center support portion 105. This rotation moment acts upon the top face of the uppermost sheet through the corner pawl 104*a* as a claw pressure, as a result of which the corner pawl 104*a* conforms to displacement of the top face of the uppermost sheet.

The swing range of the separating arm 104 may be such that it can cover an amount to which the sheet stack 2 is pushed down by the feed roller. Therefore, in consideration of easiness of manufacturing and assembling, the separating arm holding mechanism is extremely simple in structure. In consideration of a lifetime contact abrasion of a sheet feeder by paper sheets, the attachment plate 103 and the separating arm 104, which are made from metal plates, are formed each from one metal plate through stamping and bending by means of a press.

As for the central swing-center support portion 105, as shown in FIG. 12 and FIG. 13, a part of the attachment plate 103 is stamped into an inverted U shape, and the inverted U-shaped intermediate plate piece is bent at right angles to make a plate axis 109, in which arresting slits 109*a* symmetric with respect to the plate axis are punched. FIG. 13 is a cross sectional view taken on the line b—b of FIG. 12.

As shown in FIG. 14, in the separating arm 104, there is punched a central hole 112 with two insertion slits 112*a* being symmetrically cut therein. The insertion slits 112*a* are set to a width allowing the plate axis 109 of the central swing-center support portion 105 to pass through. In installing the separating arm 104 in the attachment plate 103, the separating arm 104 is rotated 90 degrees from the state shown in FIG. 14 so that the side on which the corner pawl 104*a* is formed is positioned on the lower side, and the plate axis 109 is inserted into the insertion slits 112*a*. Then, while being positioned inside the arresting slits 109*a*, the separating arm 104 is reversely rotated 90 degrees to restore a regular state. In FIG. 13, a two-dot chain line shows the separating arm 104 in the regular state. As shown in FIG. 14, the separating arm 104, which is supported by a narrow-width portion of the plate axis 109 of the attachment plate 103 at the central hole 112, is formed such that the core of the plate axis 109 is generally aligned with the center of the central hole 112. Thus, the separating arm 104 is engaged with the plate axis 109 of the attachment plate 103 at the central hole 112 so that the separating arm 104 is slidable and at the same time to arrest lateral movement of the separating arm 104 toward a direction perpendicular to a sliding axis.

In the anterior swing guide portion 106, as shown in FIG. 10, a cut slit 114 is provided in a bent portion 103*a* of the attachment plate 103. After the separating arm 104 is installed, swing of the separating arm 104 is guided by a full-face sliding portion 106*a* and an upper face sliding portion 106*b*.

In the posterior swing guide portion 108, as shown in FIG. 9, a part of the attachment plate 103 is stamped into a horseshoe shape, and the horseshoe-shaped intermediate plate piece is bent in an L shape. On the top end surface thereof, there is formed a protrusion 108*a* as shown in FIG. 11. The separating arm 104 is brought into contact with the protrusion 108*a* during sliding so that only the outside of the lower rear portion (the side not facing the attachment plate 103) is guided to slide.

For installing the separating arm 104 in the attachment plate 103, the separating arm 104 is rotated 90 degrees to be engaged with the attachment plate 103, and then is put back to the original state as described before. In this operation, while a front portion of the separating arm 104 is inserted into the cut slit 114 provided on the anterior swing guide portion 106, a rear portion of the separating arm 104 is also engaged with the protrusion 108*a* of the posterior swing guide portion 108, by which the attachment plate 103 and the separating arm are warped against each other while being rotated. A stopper 113 shown in FIG. 10 is disposed in a position where the separating arm 104 can be inserted into the slit 114 of the attachment plate 103 in the state that the attachment plate 103 and the separating arm 104 are warped against each other, and where the separating arm 104 cannot slip out from the slit 114 once the separating arm 104 is inserted and the attachment plate 103 and the separating arm 104 are returned to the original state by elasticity.

The swingable range of the separating arm 104, which is determined by a length of the slit 114 and a position of the stopper 113, covers a pushed-down amount of the sheet stack 2 when the feed roller is rotated. Through such forming process, a structurally-stable separating arm holding mechanism by three-point support is made up from the minimum number of components without the necessity of any other components and tools in installation and attachment steps.

However, with the form of the anterior swing guide portion 106 shown in FIG. 10, if deflection occurs on the separating arm 104 and the attachment plate 103 in their manufacturing step, or if warpage generated in installing the separating arm 104 in the attachment plate 103 is so large that distortion remains, the sliding resistance in the full-face sliding portion 106*a* and the upper face sliding portion 106*b* during sliding operation increases, and therefore an effort of the separating arm 104 upon paper sheets drastically changes, which works against the separation performance for separating sheets of paper. As a result, there would occur paper feeding errors such as multiple sheet pages being fed, the corner of sheet being folded, and paper jam.

Also, when the separating arm 104 is installed in the attachment plate 103 as described above, in the central swing-center support portion 105 shown in FIG. 9, the upper and lower insertion slits 112*a* of the central hole 112 shown in FIG. 14 are rotated 90 degrees so as to be engaged with the plate axis 109 of the attachment plate 103 shown in FIG. 13, and then the separating arm 104 is reversely rotated 90 degrees by the arresting slits 109*a* of the plate axis 109 to restore a previous state. When the separating arm 104 is reversely rotated 90 degrees, it is necessary to align the center of the central hole 112 with the core of the plate axis 109. If they are not aligned, the plate axis 109 comes into contact with the insertion slits 112*a*, which disables rotation of the separating arm 104.

Accordingly in the conventional separating arm holding mechanism, for easy alignment of the core of the plate axis 109 and the center of the central hole 112, guides 110 are formed symmetrically on both sides of the plate axis 109 on the attachment plate 103 by stumping and bending process (see FIG. 12 and FIG. 13), whereas in symmetric positions around the central hole 112 on the separating arm 104, slits 111 in which the guides 110 are fit are formed in a circular-arc shape large enough to cover the swing range of the separating arm 104 (see FIG. 14). In installing operation, the separating arm 104 is rotated 90 degrees and is engaged with the plate axis 109 of the attachment plate 103 through the insertion slits 112*a*, by which the guides 110 are also inserted into the slits 111. When the separating arm 104 is reversely rotated 90 degrees, the guides 110 slide inside the slits 111, which facilitates alignment of the core of the plate axis 109 and the center of the central hole 112.

However, since gaps are present between the guides 110 and the slits 111, there has been a problem that even with use of the guides 110 and the slits 111, operations of aligning the core of the plate axis 109 with the center of the central hole 112 and rotating the separating arm 104 in a reverse direction are complicated.

Further, since a part of one slit 111 is positioned above the central hole 112 of the separating arm 104 (see FIG. 14), the central swing-center support portion 105 is positioned slightly lower than the corner pawl 104*a* of the separating arm 104. Consequently, a swing track of the corner pawl 104*a* is displaced backward at the time of upward movement, whereas at the time of downward movement, the swing track is displaced forward, which increases friction with paper sheets during swing operation, thereby bringing about a problem that an effect of the separating arm 104 upon paper sheets becomes instable. Further, since the central swing-center support portion 105 is positioned on the lower side, a distance between the central swing-center support portion 105 and the posterior swing guide portion 108 is short, which would pose a problem that the installed separating arm 104 suffers considerable lost motions, thereby causing degraded precision of a product.

SUMMARY OF THE INVENTION

It is an object of the present invention to provide a separating arm holding mechanism in a sheet feeder with a separating arm method, which is capable of appropriately maintaining a claw pressure of a corner pawl on paper sheets, that is most influential to paper feeding and separating performance, regardless of displacement of a top face of the uppermost paper sheet, preventing paper feeding errors such as multiple pages being fed, a corner of paper being folded, and paper jam, and feeding paper with higher reliability. It is another object of the present invention to provide a separating arm holding mechanism that is capable of installing a separating arm in an attachment plate with easiness and high precision, and preventing generation of lost motion noises or the like so as to keep high quality as a product.

In order to accomplish the above objects, the present invention provides a separating arm holding mechanism comprising a central swing-center support portion, an anterior swing guide portion, and a posterior swing guide portion, wherein the central swing-center support portion includes a swing center portion in which a plate axis extending from the attachment plate is inserted into a hole provided at an upper center portion of the separating arm, and a lateral movement arresting portion provided on the plate axis to regulate movement of the separating arm in a direction perpendicular to a thicknesswise direction of the separating arm, the anterior swing guide portion includes a first partial sliding contact portion for guiding a swing direction of the separating arm by an opening portion of a slit with expanded recess that is provided at a front portion of the attachment plate forward of the central swing-center support portion, and the posterior swing guide portion includes a second partial sliding contact portion for guiding a swing direction of the separating arm by protrusions in contact with both sides of the separating arm provided on a lower rear side of the central swing-center support portion.

With this structure, in the state that the separating arm is restrained from moving in a direction perpendicular to its thicknesswise direction by the lateral movement arresting portion of the central swing-center support portion, and moreover that a swing direction of the separating arm is guided by the first and second partial sliding contact portions in the anterior swing guide portion and the posterior swing guide portion on the front and lower rear sides of the central swing-center support portion, the separating arm is swingably supported on the attachment plate by the swing center portion of the central swing-center support portion. Therefore, the separating arm is swingably held at three points in its longitudinal direction in a structurally stable state. Also, the separating arm is brought into contact with the first and second partial sliding contact portions of the anterior swing guide portion and the posterior swing guide portion with a small contact area, and therefore even if the separating arm or the attachment plate suffers warps generated in manufacturing process or suffers residual strain generated in installation process, excessive sliding resistance never acts upon the separating arm under swing operation.

DETAILED DESCRIPTION OF THE PREFERRED EMBODIMENTS

Figure 7:
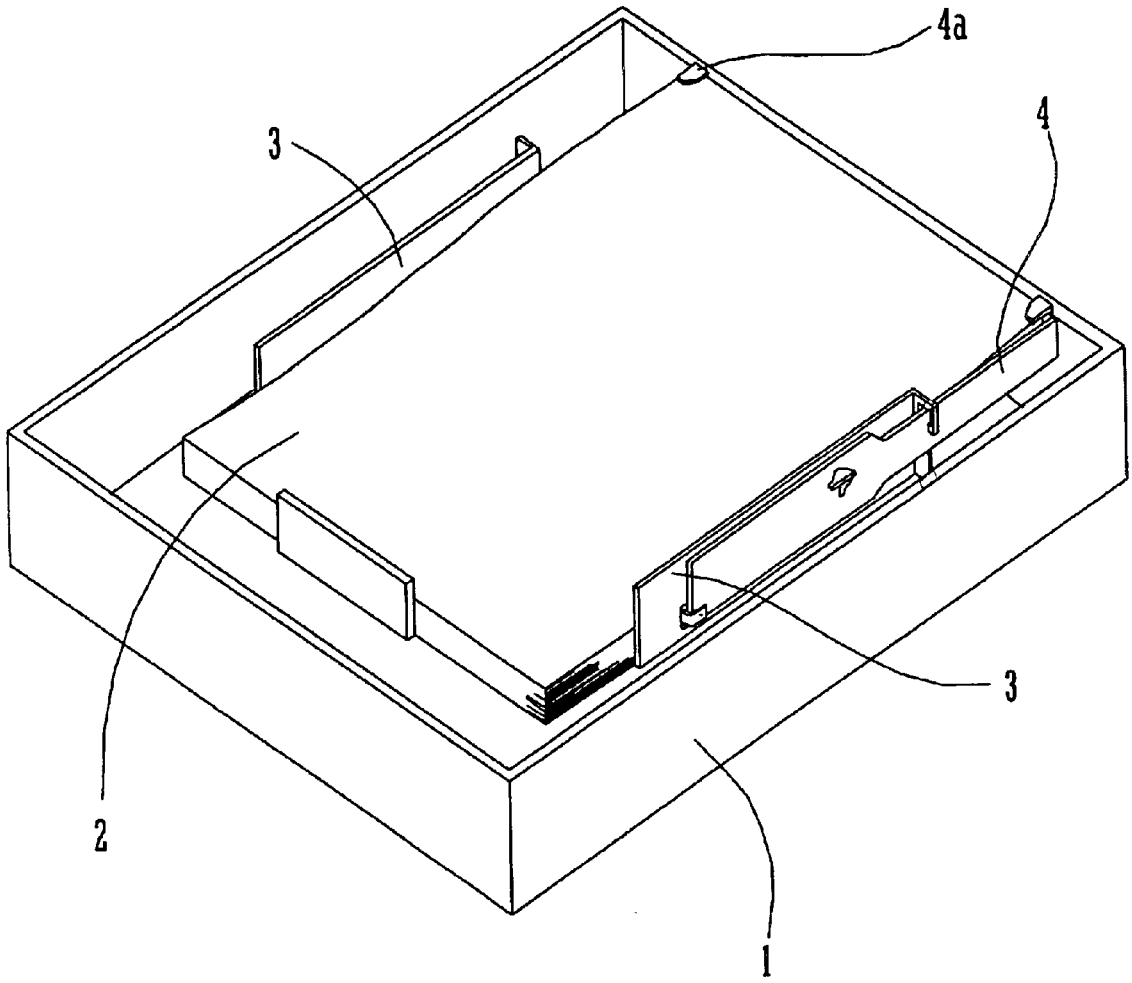
FIG. 7 is a perspective view showing one example of a sheet feeder with use of the separating arm holding mechanism of the present invention.
Figure 8:
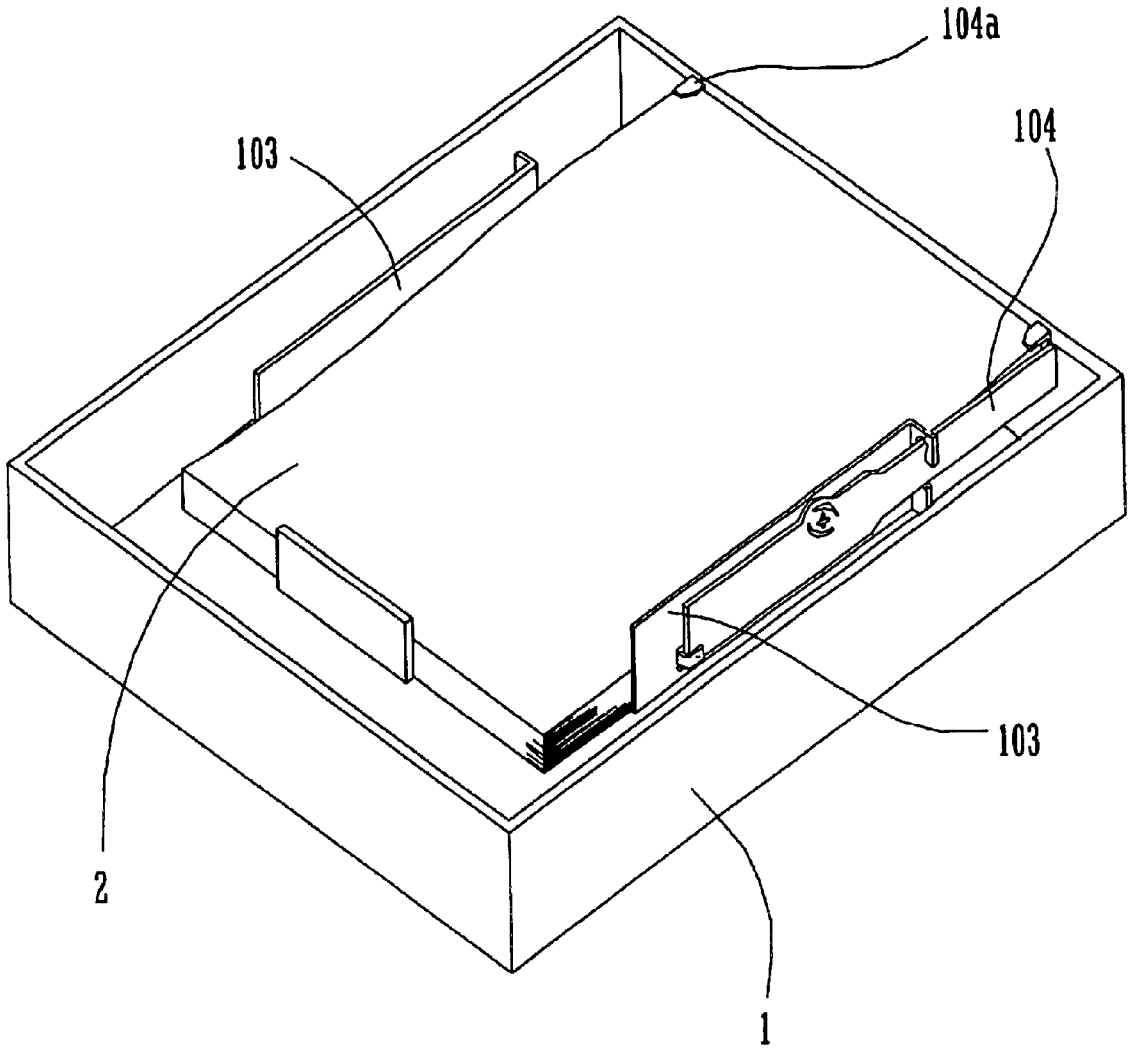
PRIOR ART FIG. 8
FIG. 8 is a perspective view showing one example of a sheet feeder with use of a conventional separating arm holding mechanism.
Figure 9:
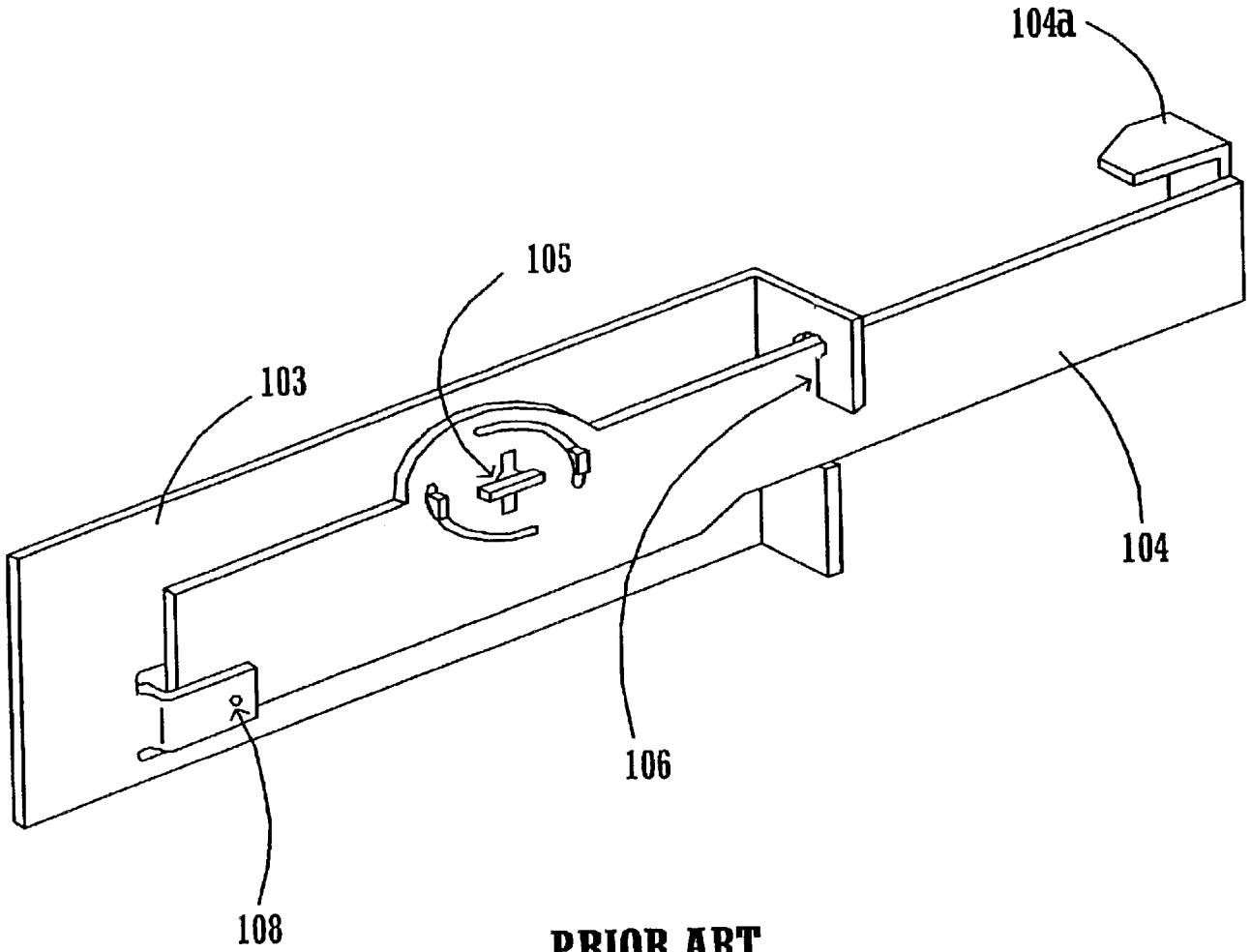
PRIOR ART FIG. 9
FIG. 9 is a perspective view showing a conventional separating arm holding mechanism.

FIG. 7 is an external view showing one example of a sheet feeder to which a separating arm holding mechanism according to an embodiment of the present invention is applied. As in the conventional separating arm holding mechanism, the separating arm holding mechanism in the embodiment of the present invention is so structured that inside a rectangular casing tray 1 with an upper face opened, a separating arm 4 with a corner pawl 4*a* formed at its end portion is supported by an attachment plate 3 that is in contact with both side ends of a sheet stack 2 to regulate the sheet width.

A portion of the sheet stack 2 on the downstream side with respect to its feeding direction (hereinafter, referred to as a front portion of the sheet stack 2) is lifted from a bottom plate of the tray 1 by elasticity of an elastic member such as springs through an unshown lift plate, so that the top face of the uppermost sheet is normally in contact with the corner pawl 4*a* regardless of the volume of the sheet stack 2. Above the front portion of the sheet stack 2, an unshown semicircular feed roller is disposed so as to be rotatable. During feeding operation, the feed roller rotates so as to move a sheet to the downstream side of the feeding direction, while pressing down the entire sheet stack 2 against the elasticity of an elastic member to keep tight contact with the top face of the uppermost sheet of the sheet stack 2. In this operation, since the uppermost sheet of the sheet stack 2 is restrained from moving to the downstream side of the feeding direction by the corner pawl 4*a*, sagging occurs on the portion of the uppermost sheet on the downstream side in its feeding direction, as a consequence of which a resilience due to the sagging makes the sheet's both end corner portions on the downstream side in the feeding direction overpass the corner pawl 4*a*. This enables feeding of only the uppermost sheet.

Figure 1:
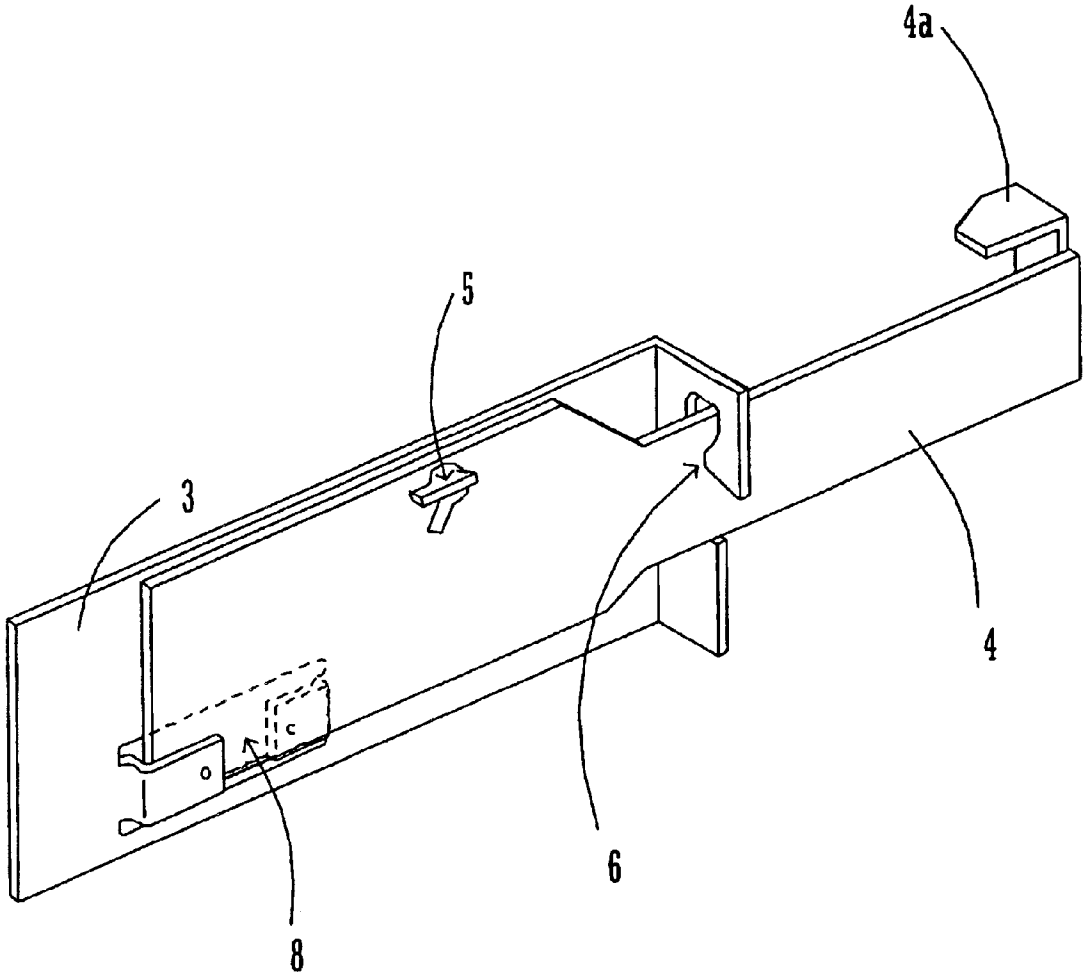
FIG. 1 is a perspective view showing a separating arm holding mechanism, which is an example of the present invention.

The separating arm 4 having the corner pawl 4*a* is supported by the attachment plate 3 so that the corner pawl 4*a* comes into contact with the top face of the uppermost sheet in the sheet stack 2 at an appropriate pressure (claw pressure) in conformity with displacement of the top face of the uppermost sheet generated when the entire sheet stack 2 is pushed down by rotation of the feed roller. More specifically, as shown in FIG. 1, the separating arm 4 having the corner pawl 4*a* is slidably supported at three points: a central swing-center support portion 5; an anterior swing guide portion 6; and a posterior swing guide portion 8, each formed on the attachment plate 3. These central swing-center support portion 5, the anterior swing guide portion 6 and the posterior swing guide portion 8 constitute a separating arm holding mechanism.

When the top face of the uppermost sheet is displaced downward by rotation of the feed roller, the rotation moment by its own weight is generated on the separating arm 104 around the central swing-center support portion 5. This rotation moment acts upon the top face of the uppermost sheet through the corner pawl 4*a* as a claw pressure, as a result of which the corner pawl 4*a* conforms to displacement of the top face of the uppermost sheet.

The swing range of the separating arm 4 may be such that it can cover an amount to which the sheet stack 2 is pushed down by the feed roller. Therefore, in consideration of easiness of manufacturing and assembling, the separating arm holding mechanism is extremely simple in structure. The attachment plate 3 and the separating arm 4, which are made from metal plates, are formed each from one metal plate through stamping and bending by means of a press.

Figure 4:
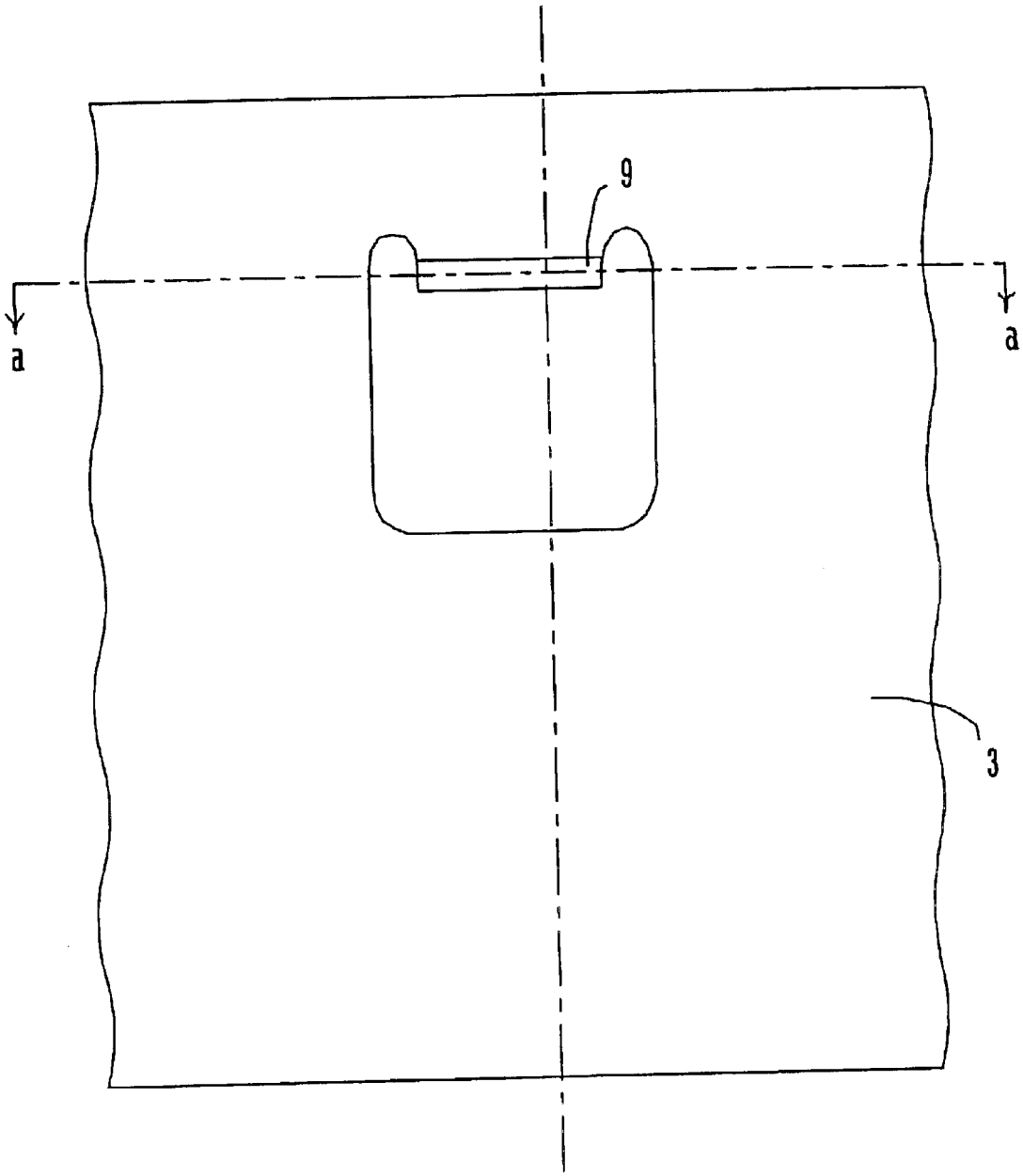
FIG. 4 is a fragmentary view showing a central swing-center support portion of an attachment plate of FIG. 1.
Figure 5:
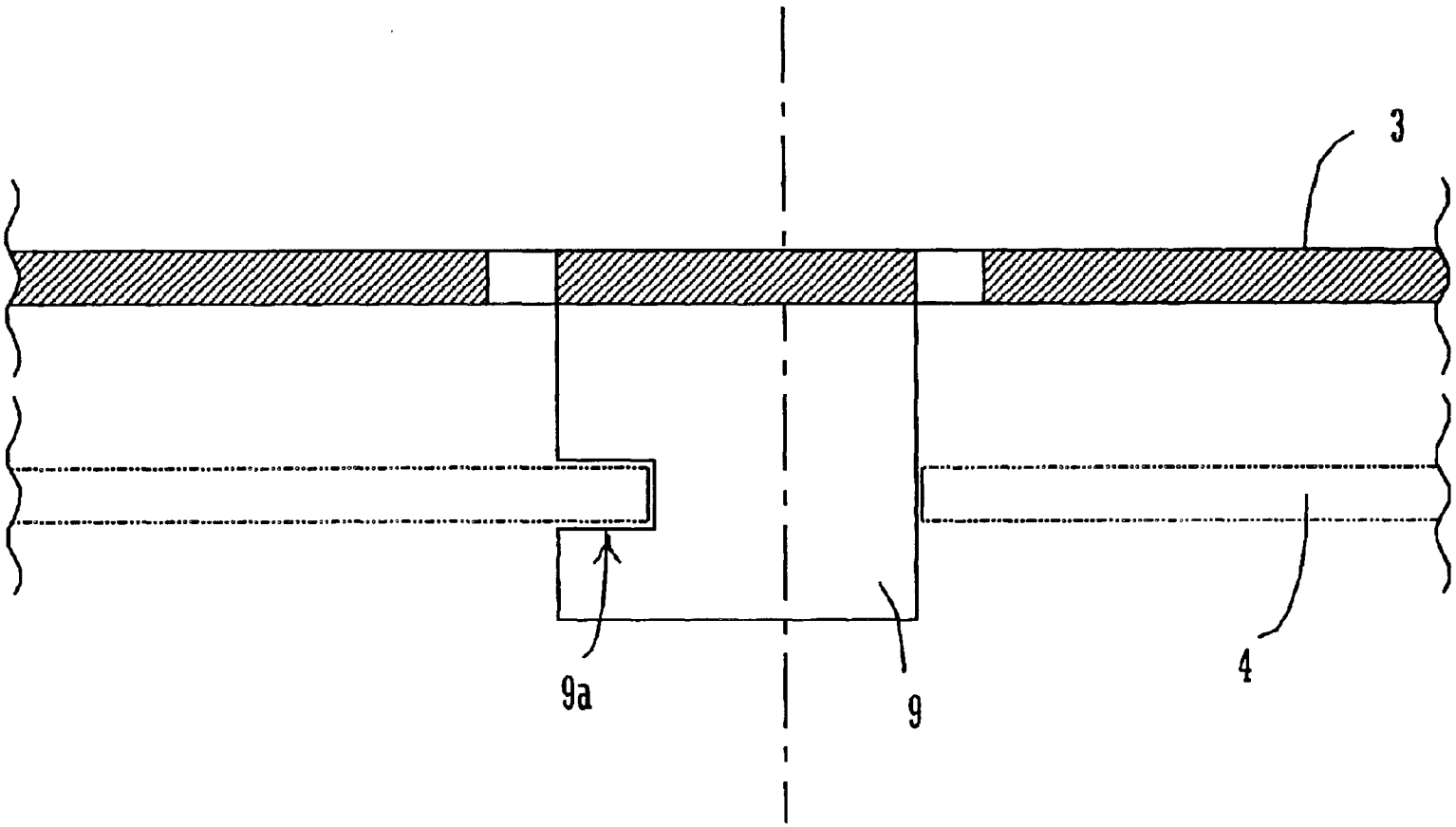
FIG. 5 is a cross sectional view taken on the line a—a of FIG. 4.

As for the central swing-center support portion 5, as shown in FIG. 4 and FIG. 5, a part of the attachment plate 3 positioned eccentric from a swing-center of the separating arm 4 is stamped into a U shape, and the U-shaped intermediate plate piece is bent at right angles to make a plate axis 9, in which there is punched an arresting slit 9*a* on a side of larger area with respect to a swing-center of the separating arm 4. The width of the arresting slit 9*a* is set to be slightly larger than the thickness of the separating arm 4. It is noted that FIG. 5 is a cross sectional view taken on the line a—a of FIG. 4.

Figure 6:
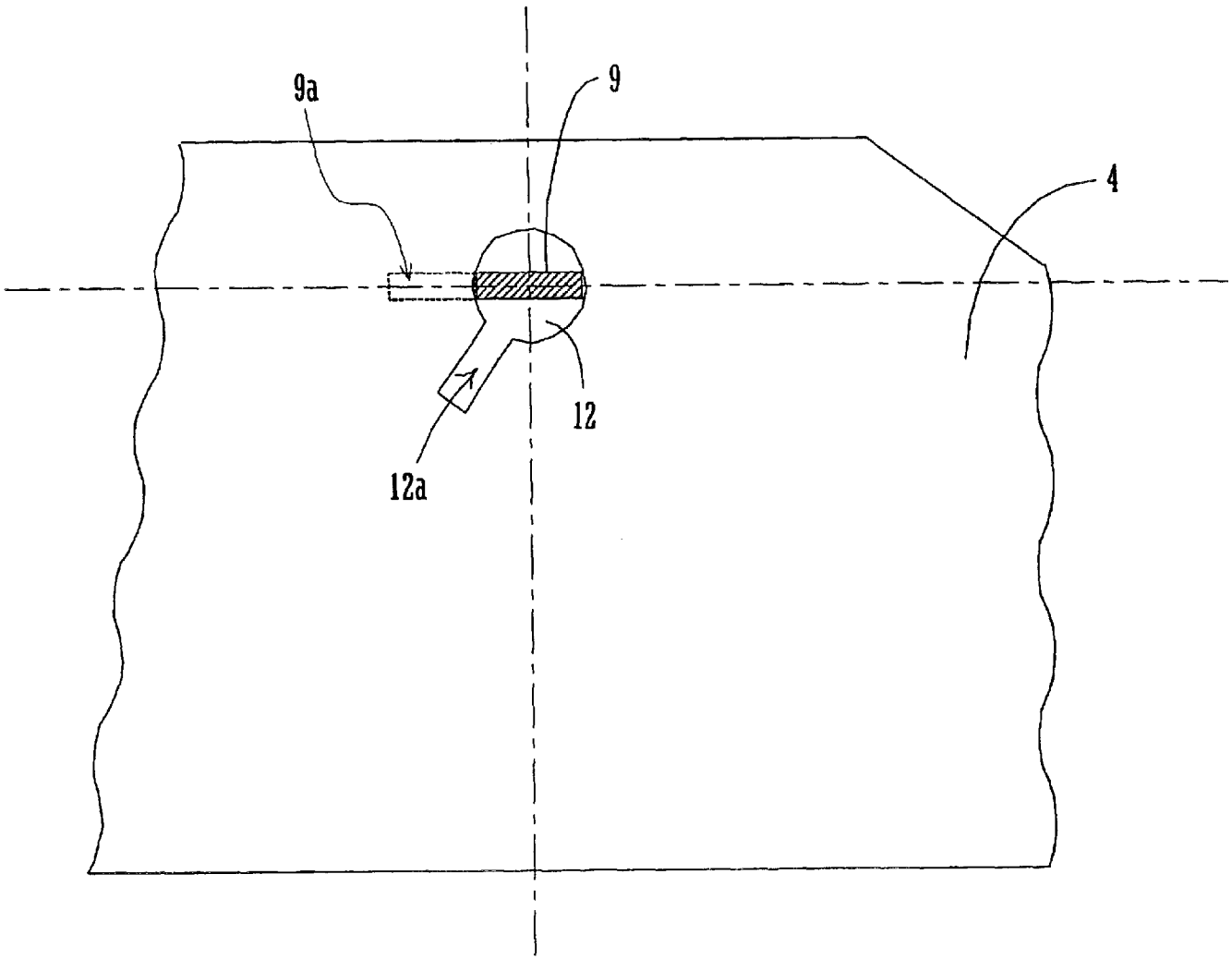
FIG. 6 is a cross sectional view showing the central swing-center support portion of FIG. 1.

As shown in FIG. 6, in the separating arm 4, there is punched a hole 12 with an insertion slit 12*a* being cut therein at an angle of 45 degrees below the horizontal. The width of the insertion slit 12*a* is set to be slightly larger than the thickness of the plate axis 9 of the attachment plate 3.

In installing the separating arm 4 in the attachment plate 3, the separating arm 4 is rotated 45 degrees so that the corner pawl 4*a* side is inclined obliquely downward, and the plate axis 9 is inserted into the insertion slit 12*a*. Then, at the arresting slit 9*a* of the plate axis 9, the separating arm 4 is reversely rotated 45 degrees to restore a regular state. In FIG. 5, a two-dot chain line shows the separating arm 4 in the regular state.

As shown in FIG. 6, a hole diameter of the hole 12 of the separating arm 4 is set to be slightly larger than the width of a portion of the plate axis 9 of the attachment plate 3 narrowed by the arresting slit 9*a*. Therefore, a center of the portion of the plate axis 9 narrowed by the arresting slit 9*a* is generally aligned with a center of the hole 12. As a consequence, the separating arm 4 is swingably supported by the plate axis 9 of the attachment plate 3 at the hole 12 in the state that movement to a thicknesswise direction of the separating arm 4 is regulated. It is noted that the plate axis 9, the hole 12, and the insertion slit 12*a* constitute a swing center portion of the present invention, and the arresting slit 9*a* is equivalent to a lateral movement arresting portion of the present invention.

Figure 2:
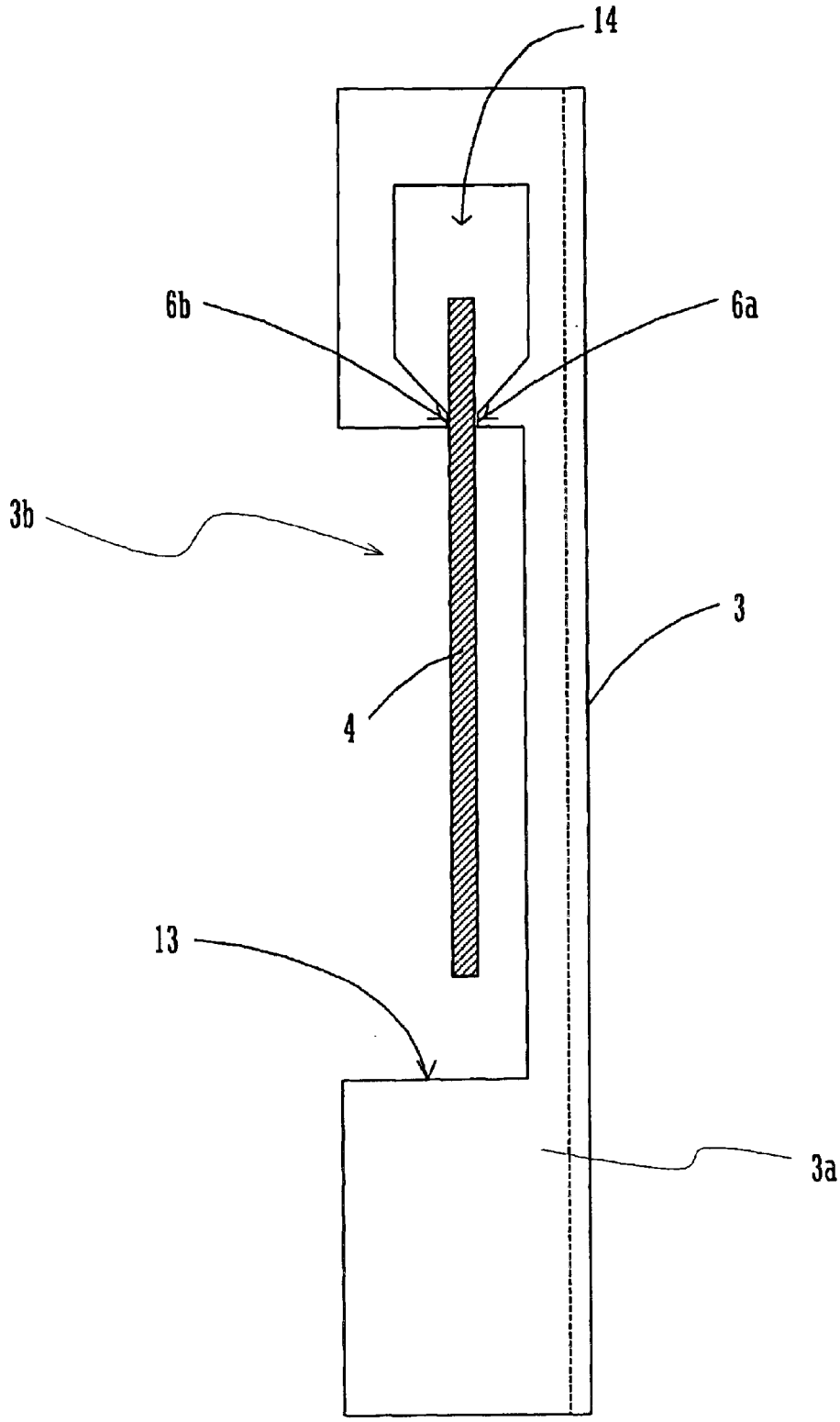
FIG. 2 is a cross sectional view showing an anterior swing guide portion of FIG. 1.

In the anterior swing guide portion 6, as shown in FIG. 2, a cut 3*b* and a slit with expanded recess 14 are formed in a bent portion 3*a* of the attachment plate 3. At an opening end of the slit with expanded recess 14, there are formed sliding portions 6*a*, 6*b* with a gap therebetween being slightly larger than the thickness of the separating arm 4. The sliding portions 6*a* and 6*b* form a first partial sliding contact portion of the present invention. Eventually, after installed in the attachment plate 3, the separating arm 4 is guided to be slid by the sliding portions 6*a*, 6*b* whose gap is extremely small compared to a conventional case.

Figure 3:
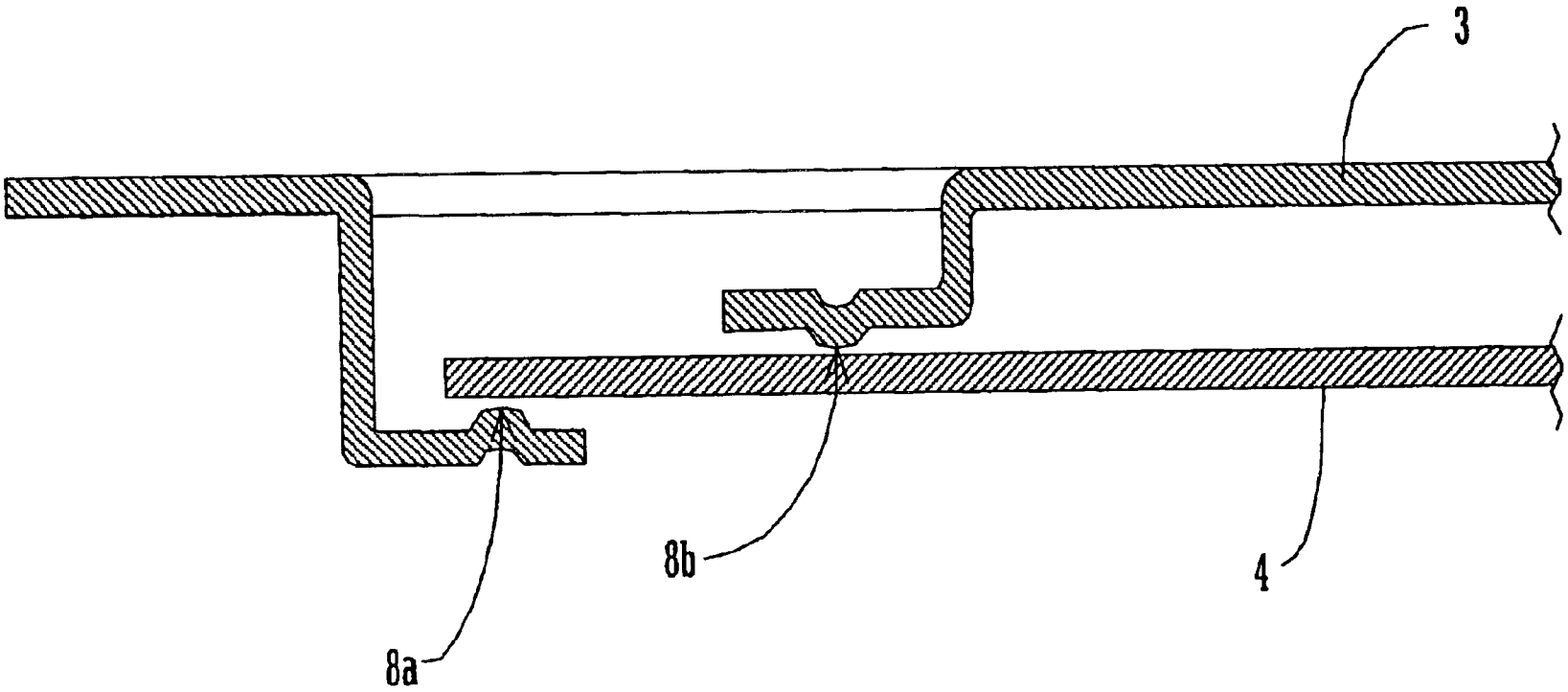
FIG. 3 is a cross sectional view showing a posterior swing guide portion of FIG. 1.

In the posterior swing guide portion 8, after a part of the attachment plate 3 is stamped into an I shape, two resulting intermediate plate pieces are each bent in an L shape as shown in FIG. 3, and at the same time, protrusions 8*a*, 8*b* are formed on faces of the posterior swing guide portion 8 parallel to the attachment plate 3. The protrusions 8*a* and 8*b* form a second partial sliding contact portion of the present invention. The separating arm 4 installed in the attachment plate 3 is positioned between the protrusions 8*a* and 8*b* and is guided to be swung from both sides of the separating arm 104 with respect to its thicknesswise direction.

For installing the separating arm 4 in the attachment plate 3, the separating arm 4 is rotated 45 degrees to make the plate axis 9 inserted into the central hole 12 as described above, and then the separating arm 4 is reversely rotated to restore the original state. In this operation, while a front portion of the separating arm 4 is inserted in between the sliding portions 6*a* and 6*b* of the slit with expanded recess 14 in the anterior swing guide portion 6, a rear portion of the separating arm 4 is inserted in between the protrusions 8*a* and 8*b* in the posterior swing guide portion 8 at the same time, by which the attachment plate 3 and the separating arm 4 are warped against each other, and in this state, the separating arm 4 is reversely rotated.

A stopper 13 formed in the attachment plate 3, which is shown in FIG. 2, is disposed in the position where the separating arm 4 can be inserted into the slit with expanded recess 14 of the attachment plate 3 by warping the attachment plate 3 and the separating arm 4 against each other, and where the separating arm 4 cannot slip out from the slit with expanded recess 14 once the warpage of both the attachment plate 3 and the separating arm 4 is removed after insertion. The slidable range of the separating arm 4, which is determined by the length of the slit with expanded recess 14 and the position of the stopper 13, covers a pushed-down amount of the sheet stack 2 by the feed roller. Through such forming process, a structurally-stable separating arm holding mechanism by three-point support can be made up from the minimum number of components without the necessity of any other components and tools in installation and attachment steps.

Figure 10:
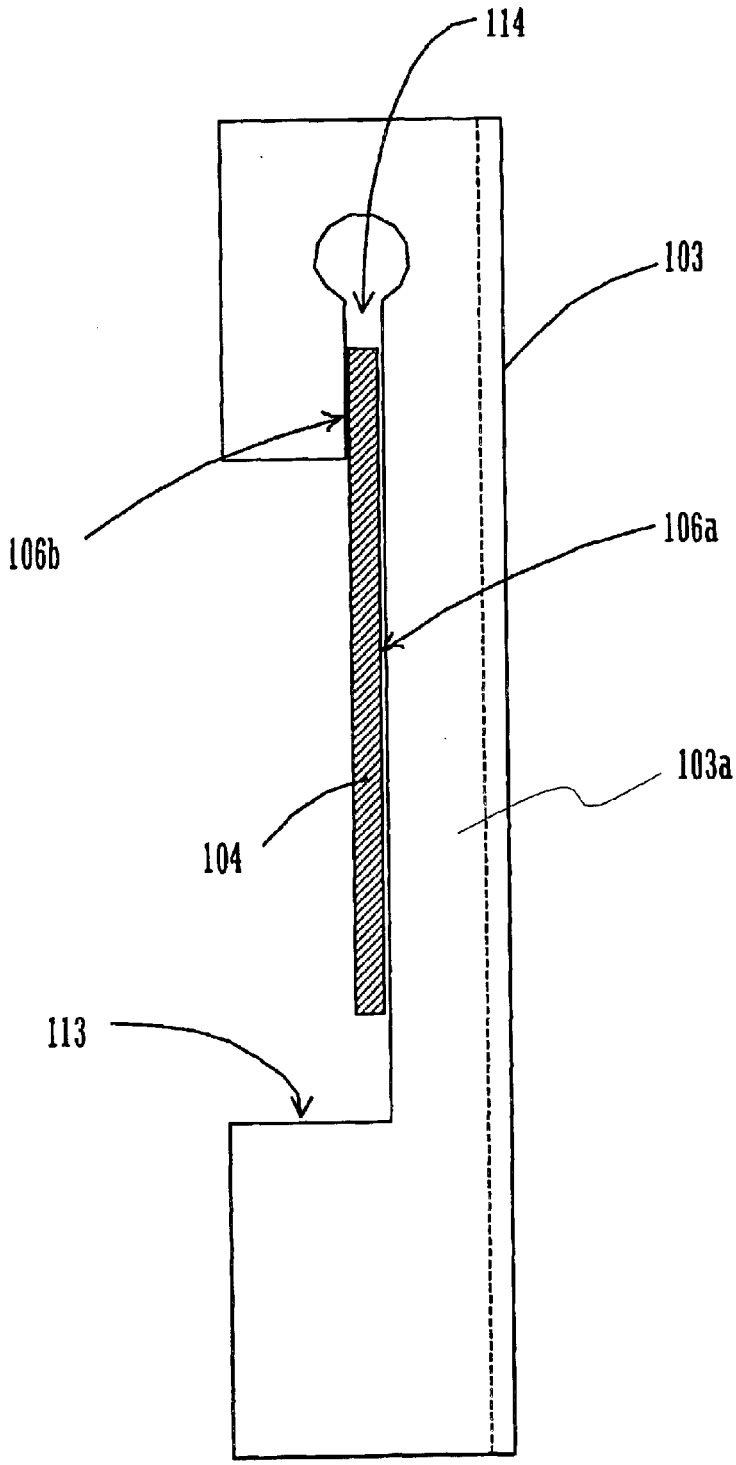
PRIOR ART FIG. 10
FIG. 10 is a cross sectional view showing the anterior swing guide portion of FIG. 9.
Figure 11:
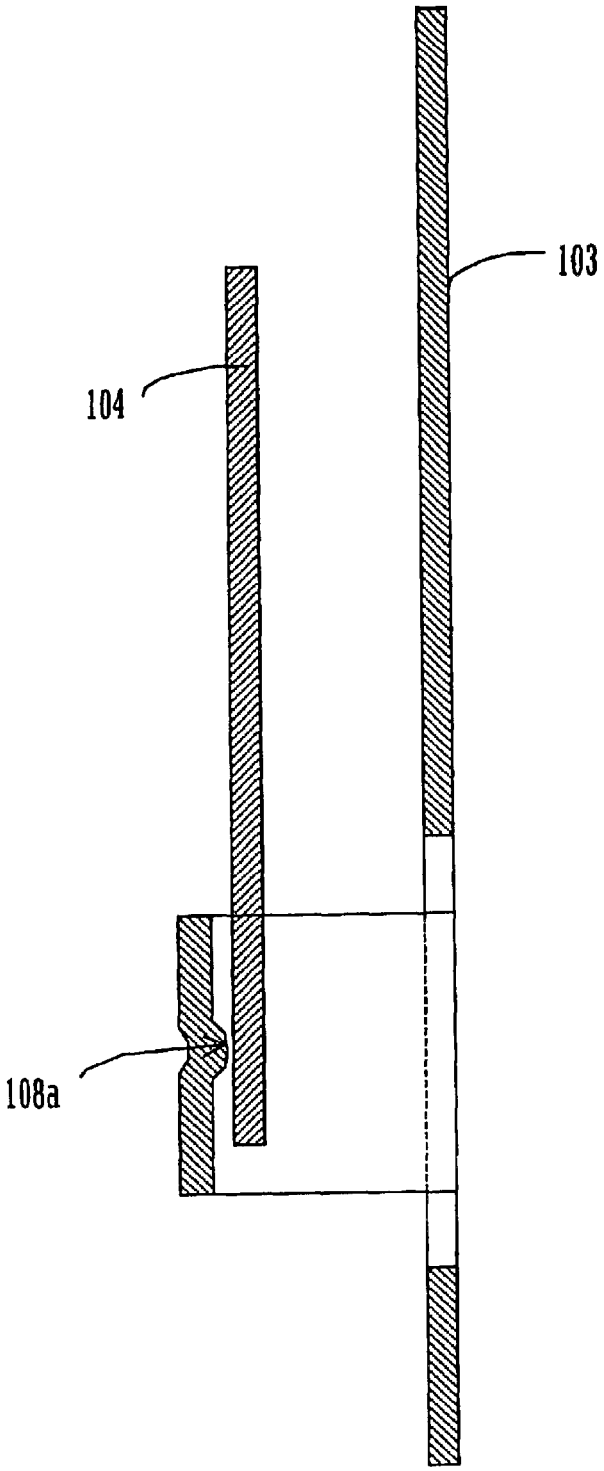
PRIOR ART FIG. 11
FIG. 11 is a cross sectional view showing the posterior swing guide portion of FIG. 9.
Figure 12:
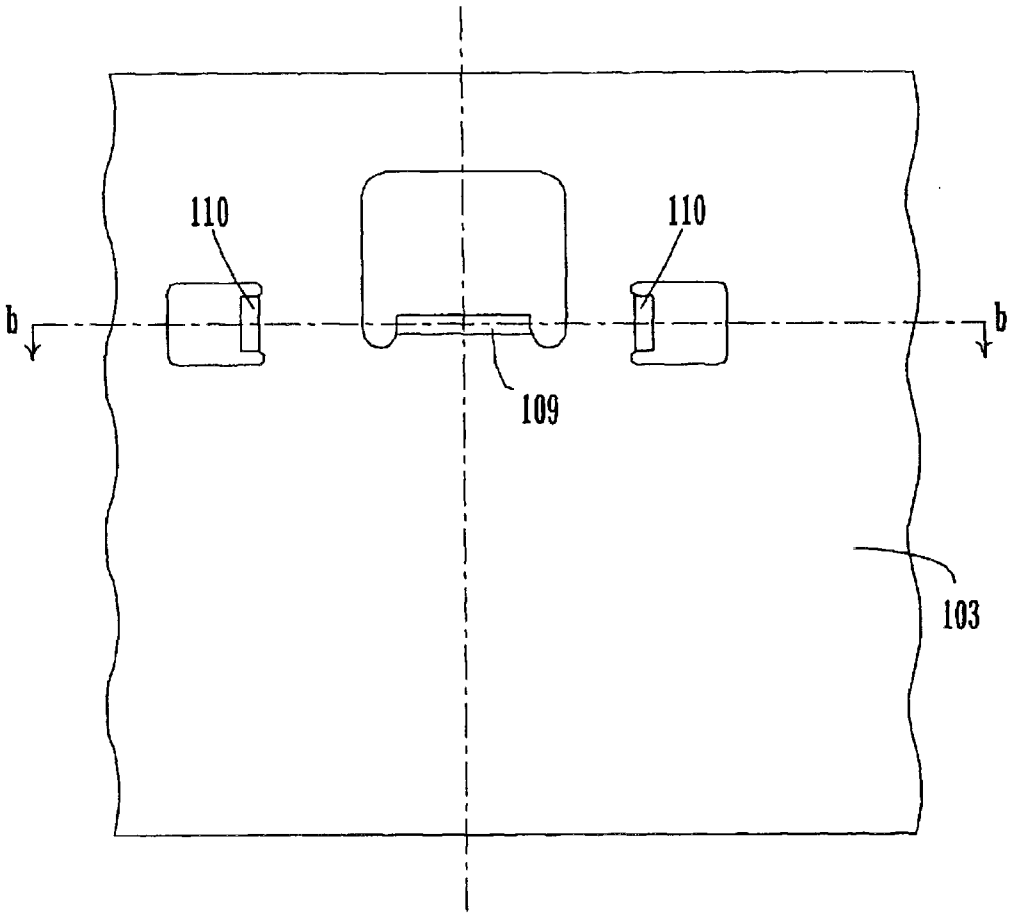
PRIOR ART FIG. 12
FIG. 12 is a fragmentary view showing the central swing-center support portion of an attachment plate of FIG. 9.

More specifically, in the case of the conventional separating arm holding mechanism by the three-point support, as shown in FIG. 10, the anterior swing guide portion 106 brings the full-face sliding portion 106*a* into contact with the vertically entire region on one face of the separating arm 104, and at the same time brings the upper face sliding portion 106*b* into contact with a specified region on an upper side of the other face of the separating arm 104 for guiding sliding of the separating arm 104. Consequently, if deflection occurs on the separating arm 104 or the attachment plates 103 in their manufacturing step, or if warpage generated in an installation operation is so large that distortion remains, large sliding resistance acts upon the separating arm 4 from the full-face sliding portion 106*a* and the upper face sliding portion 106*b* during sliding operation, and therefore an effort of the separating arm 104 acting upon paper sheets drastically changes, which works against the separation performance for separating sheets of paper.

In contrast to this, in the case of the separating arm holding mechanism according to this embodiment, the anterior swing guide portion 6 is so structured that the separating arm 4 is guided to be swung in an extremely small range in a vertical direction of both sides by the sliding portions 6*a* and 6*b*. As a consequence, the separating arm 4 is made insusceptible to influences of residual distortion generated on the separating arm 4 or the attachment plate 3 in a manufacturing operation or in an installation operation, and moreover, sliding resistance acting during sliding operation is suppressed. Thus, the separating arm 4 is enabled to stably maintain a specified claw pressure acting on the upper face of the uppermost sheet even if the upper face of the uppermost sheet is displaced by rotation of the feed roller, so that high sheet separation performance of the separating arm 4 can be maintained.

Figure 13:
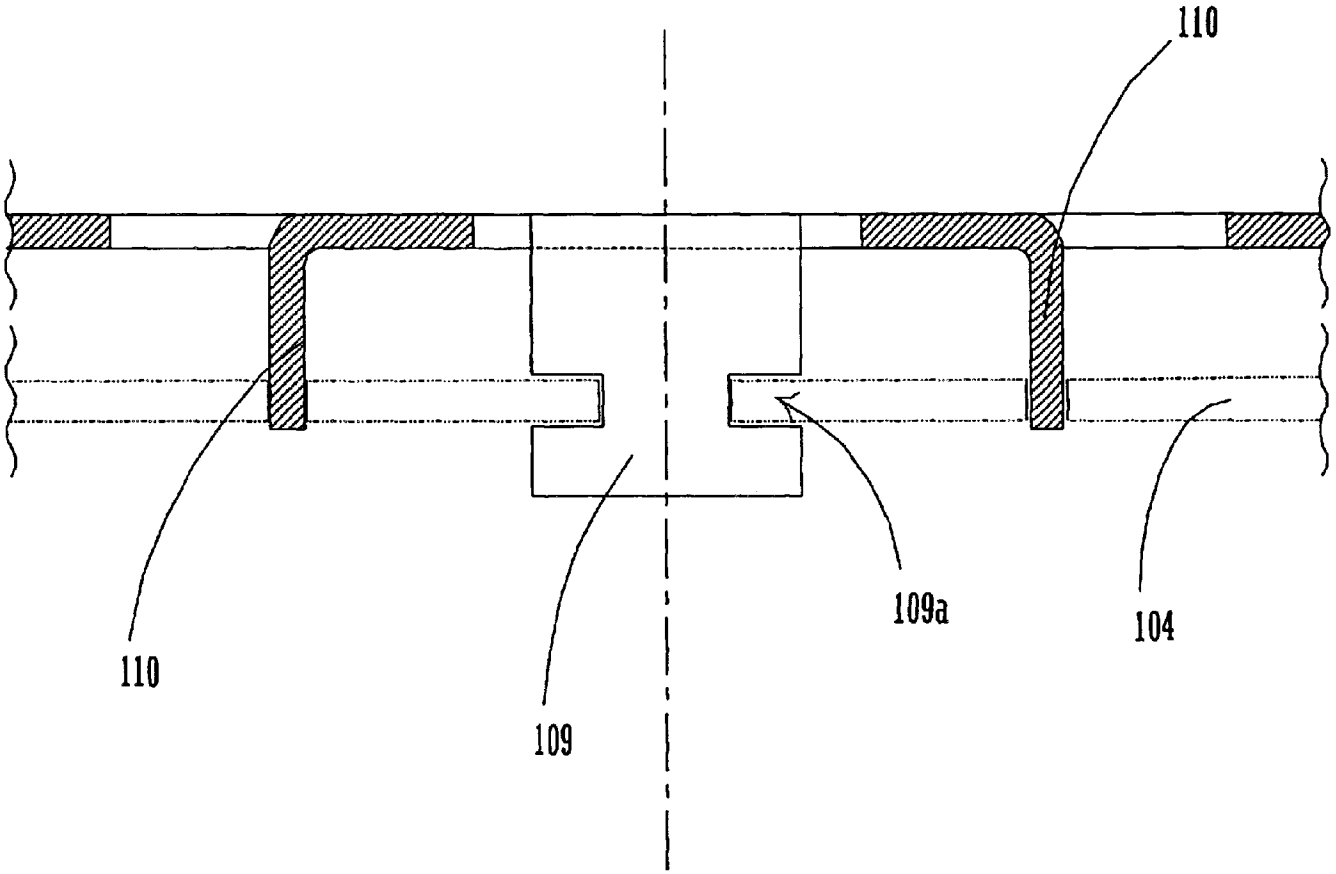
PRIOR ART FIG. 13
FIG. 13 is a cross sectional view taken on the line b—b of FIG. 12.
Figure 14:
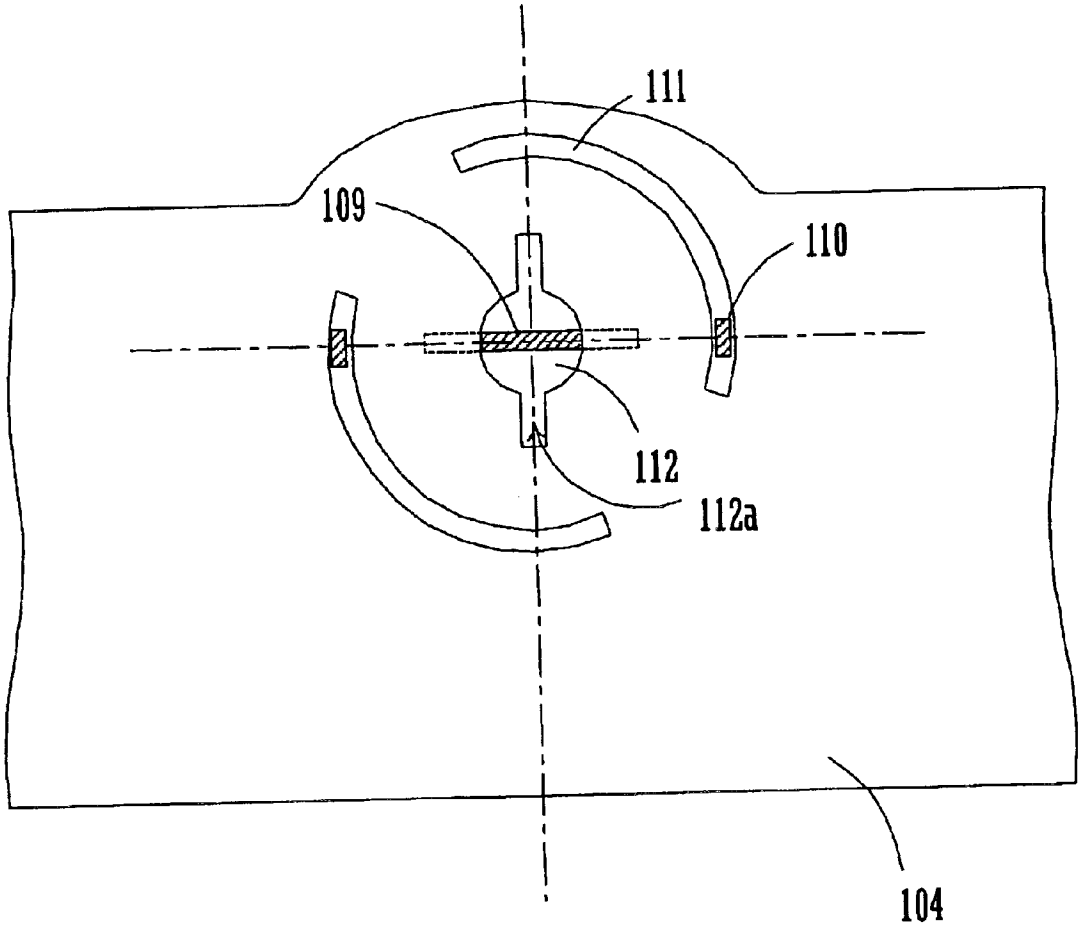
PRIOR ART FIG. 14
FIG. 14 is a cross sectional view showing the central swing-center support portion of FIG. 9.

Also, in the case of the central swing-center support portion 105 in the conventional separating arm holding mechanism, when the separating arm 104 is installed in the attachment plates 103, the separating arm 104 is engaged with the plate axis 109 of the attachment plates 103 shown in FIG. 13 in the state that the upper and lower insertion slits 112*a* of the central hole 112 shown in FIG. 14 are rotated 90 degrees, and by a guidance of the engagement between the guides 110 of the attachment plates 103 and the slits 111 of the separating arm 104, the separating arm 104 is reversely rotated 90 degrees at the position of the arresting slits 109*a* of the plate axis 109 to restore a previous position. However, there has been a problem that gaps between the guides 110 and the slits 111 hinder smooth alignment of the central positions and rotation of the separating arm 104.

In contrast to this, in the separating arm holding mechanism according to this embodiment, in installing the separating arm 4 in the attachment plate 3, the plate axis 9 is inserted into the insertion slit 12*a* in the state that the separating arm 4 is rotated 45 degrees so that the corner pawl 4*a* side is inclined obliquely downward, and then, in the state that movement of the separating arm 4 in its thicknesswise direction is regulated by the arresting slit 9*a*, the separating arm 4 is reversely rotated 45 degrees to restore a regular state. Consequently, when the separating arm 4 is reversely rotated, pressing an inner circumferential face of the central hole 12 of the separating arm 4 to the plate axis 9 makes it extremely easy to align the centers of the plate axis 9 and the central hole 12, thereby facilitating reverse rotation of the separating arm 4 to restore a regular state. This eliminates the necessity of providing guiding members such as guides and slits as in the conventional separating arm holding mechanism, and simplifies manufacturing and installation operations.

Further, in the central swing-center support portion 105 in the conventional separating arm holding mechanism, a part of one slit 111 is positioned above the central hole 112 of the separating arm 104 (see FIG. 14), so that the central swing-center support portion 105 is positioned slightly lower than the corner pawl 104*a* of the separating arm 104. Consequently, a swing track of the corner pawl 104*a* is displaced backward at the time of upward movement, whereas at the time of downward movement, the swing track is displaced forward, which increases friction with paper sheets during swing operation, thereby bringing about a problem that an effect of the separating arm 104 upon paper sheets becomes instable.

In contrast to this, in the separating arm holding mechanism in this embodiment, as shown in FIG. 1, the central swing-center support portion 5 is formed at a high position so that a tangent line of a track of the corner pawl drawn by sliding of the separating arm 4 in the state that the separating arm 4 is in an uppermost position in a sliding range of the separating arm is generally in conformity with a plumb line, by which the corner pawl 4*a* may be moved up and down in an approximately vertical direction along with sliding of the separating arm 4. This makes it possible to prevent the corner pawl 4*a* from exerting an excess force to the paper sheet, and to make a constant claw pressure smoothly exerted on the sheet from the corner pawl 4*a*, thereby stabilizing an effort of the separating arm 4 upon the paper sheet. Also, since the central swing-center support portion 5 is positioned relatively on the upper side, a distance between the central swing-center support portion 5 and the posterior swing guide portion 8 facing a vicinity of the posterior lower end of the separating arm 4 is elongated, which decreases lost motions of the installed separating arm 4 even if manufacturing precision of the attachment plate 3 and the separating arm 4 is the same as conventional precision, allowing the product precision to be improved.

Figure 15:
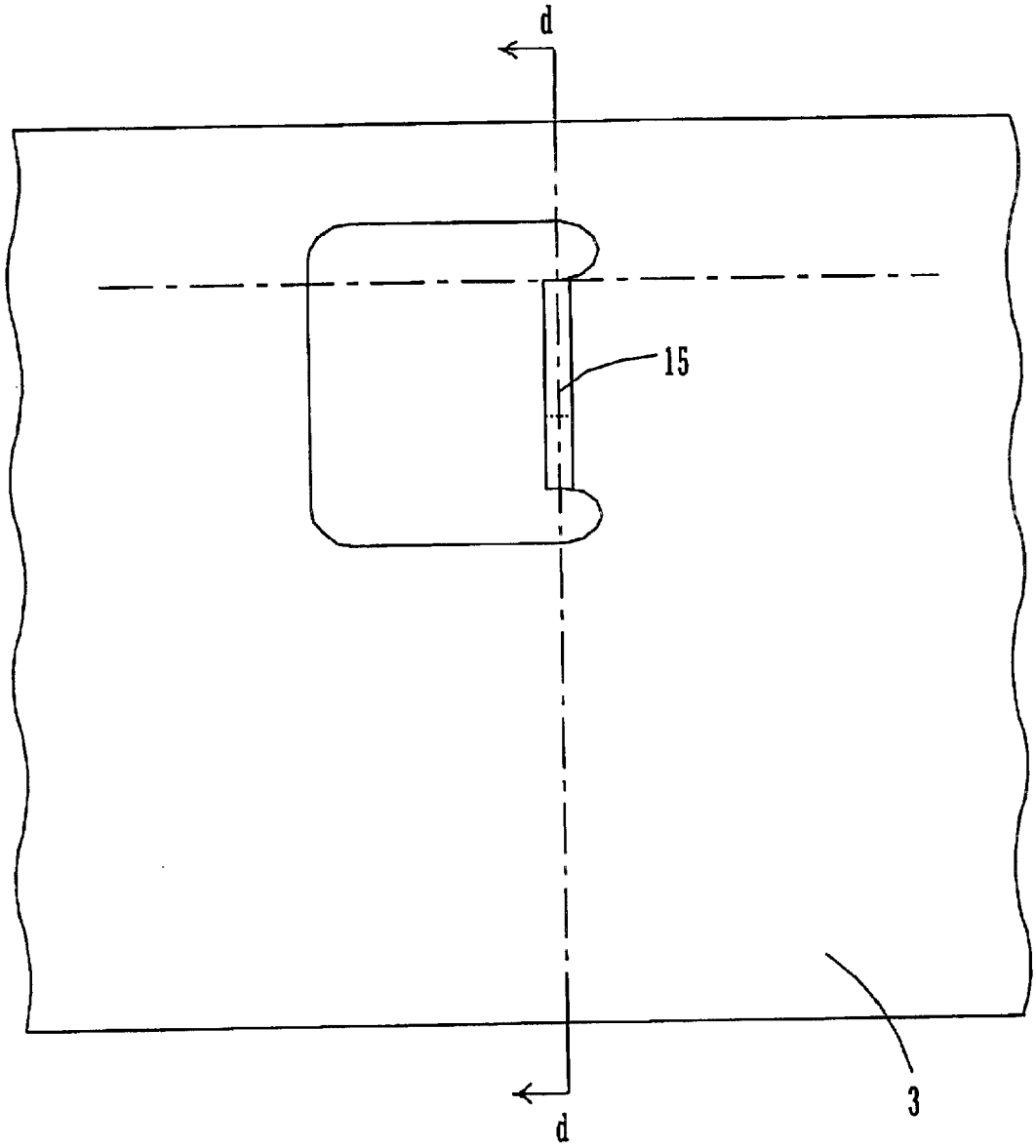
FIG. 15 is a fragmentary view showing the central swing-center support portion of an attachment plate, which is an example of the present invention.
Figure 16:
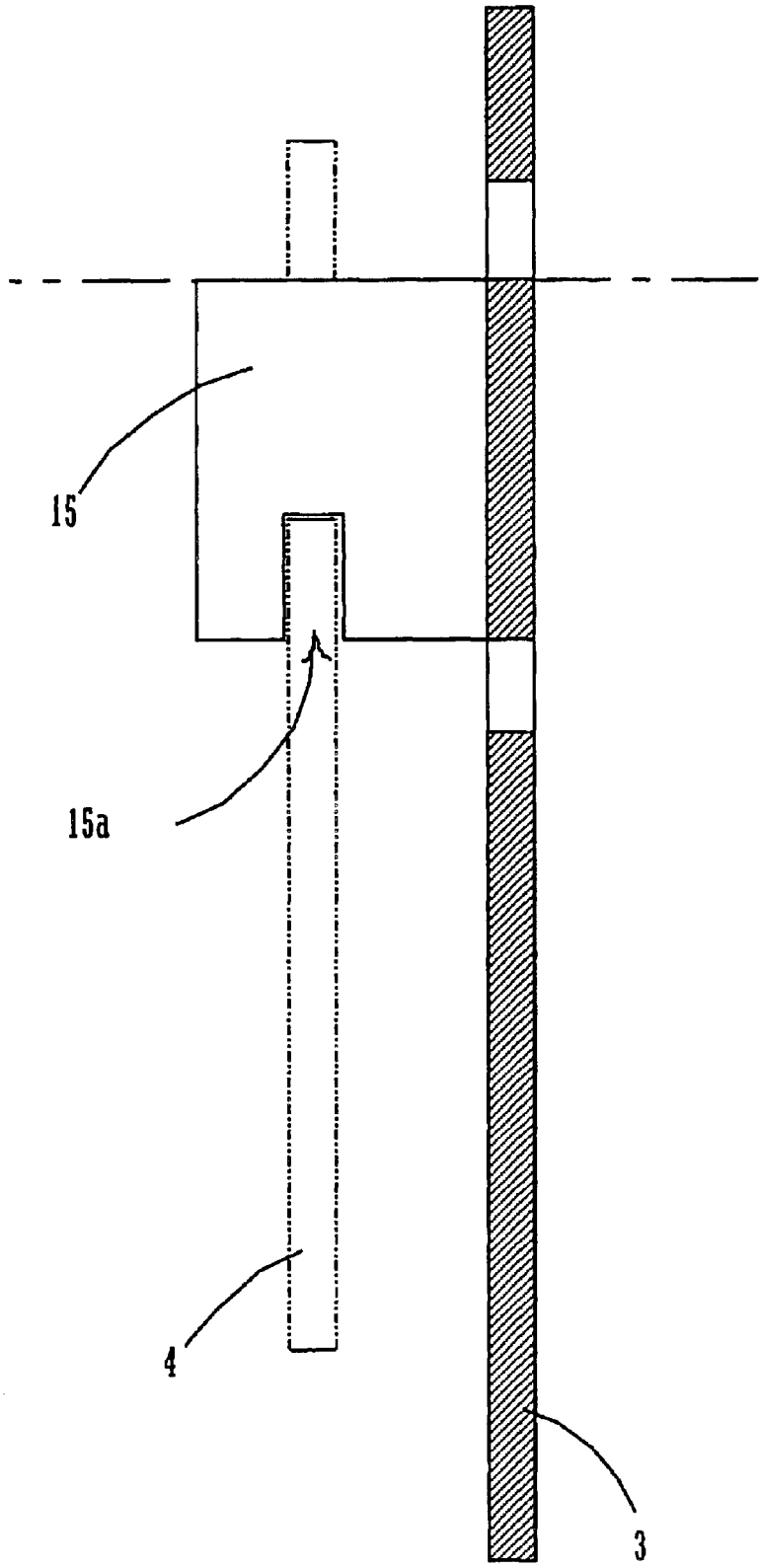
FIG. 16 is a cross sectional view taken on the line d—d of FIG. 15.
Figure 17:
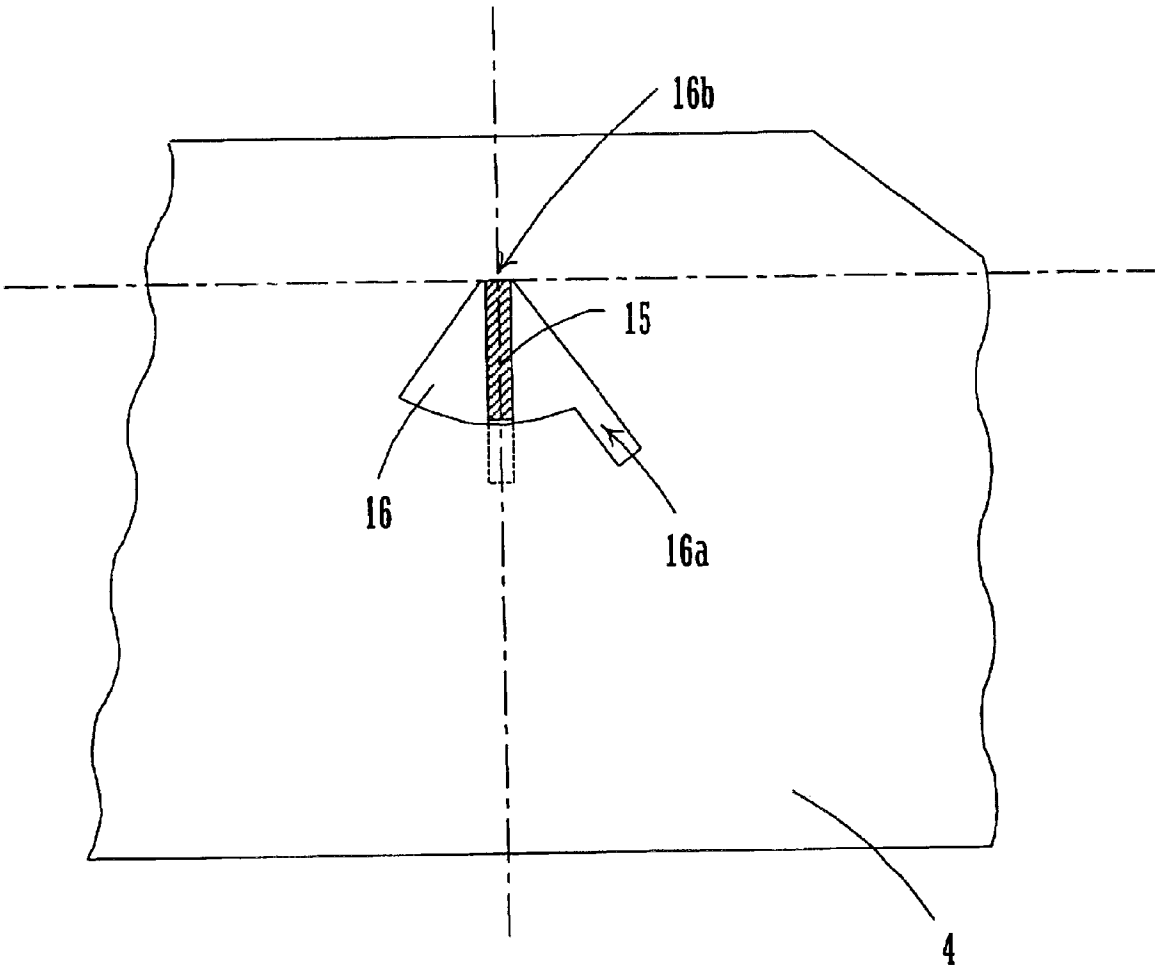
FIG. 17 is a cross sectional view showing the central swing-center support portion of FIG. 15.

It is noted that the central swing-center support portion 5 may take a shape shown in FIGS. 15 to 17. More particularly, there are formed: a vertical sliding support plate 15 formed by bending a part of the attachment plate 3; a fan-shaped hole 16 that is positioned on an upper side of a central portion of the separating arm 4 and is smaller than a length of the sliding support plate 15 with a head portion positioned on an upside for engaging the separating arm 4 with the swing support plate 15; an arresting slit 15*a* provided on the lower side of the swing support plate 15 for arresting lateral movement of the separating arm 4; and an insertion slit 16*a* provided on one end of the fan-shaped hole 16 toward a lower direction for inserting the swing support plate 15 into the fan-shaped hole 16 at a shifted angle in installing the separating arm 4 in the attachment plate 3.

After the swing support plate 15 is inserted into the insertion slit 16*a*, a head portion 16*b* of the fan-shaped hole 16 is supported by the swing support plate 15, so that the fan-shaped hole 16 can be fit in a clearance-fit state with a narrow portion of the swing support plate 15, by which at a position of the arresting slit 15*a* of the swing support plate 15, the separating arm 4 can be easily rotated in a reverse direction to restore a regular state. FIG. 16 is a cross sectional view taken on the line d—d of FIG. 15. In this case, the sliding center of the separating arm 4 is a portion on an upper end of the swing support plate 15, with which the head portion of the fan-shaped hole 16 of the separating arm 4 comes into contact.

In the shape shown in FIGS. 15 to 17, the upper end of the swing support plate 15 and the head portion 16*b* of the fan-shaped hole 16 come into rolling contact with each other during swing of the separating arm 4, and therefore the sliding resistance is smaller than that in the shape shown in FIGS. 4 to 6 in which the inner circumferential face of the central hole 12 comes into contact with an end portion of the plate axis 9 during the swing of the separating arm 4. Also in the shape shown in FIGS. 4 to 6, a corner portion of the plate axis 9 comes into wedge-like contact with the inner circumferential face of the central hole 12. Because of this wedge effect, a contact pressure between the plate axis 9 and the central hole 12 rises and thereby the sliding resistance during swing operation of the separating arm 4 becomes large. With respect to this point, the shape shown in FIGS. 15 to 17 is free from rise of the contact pressure due to the wedge effect, which decreases wear and prolongs product life.

Figure 18:
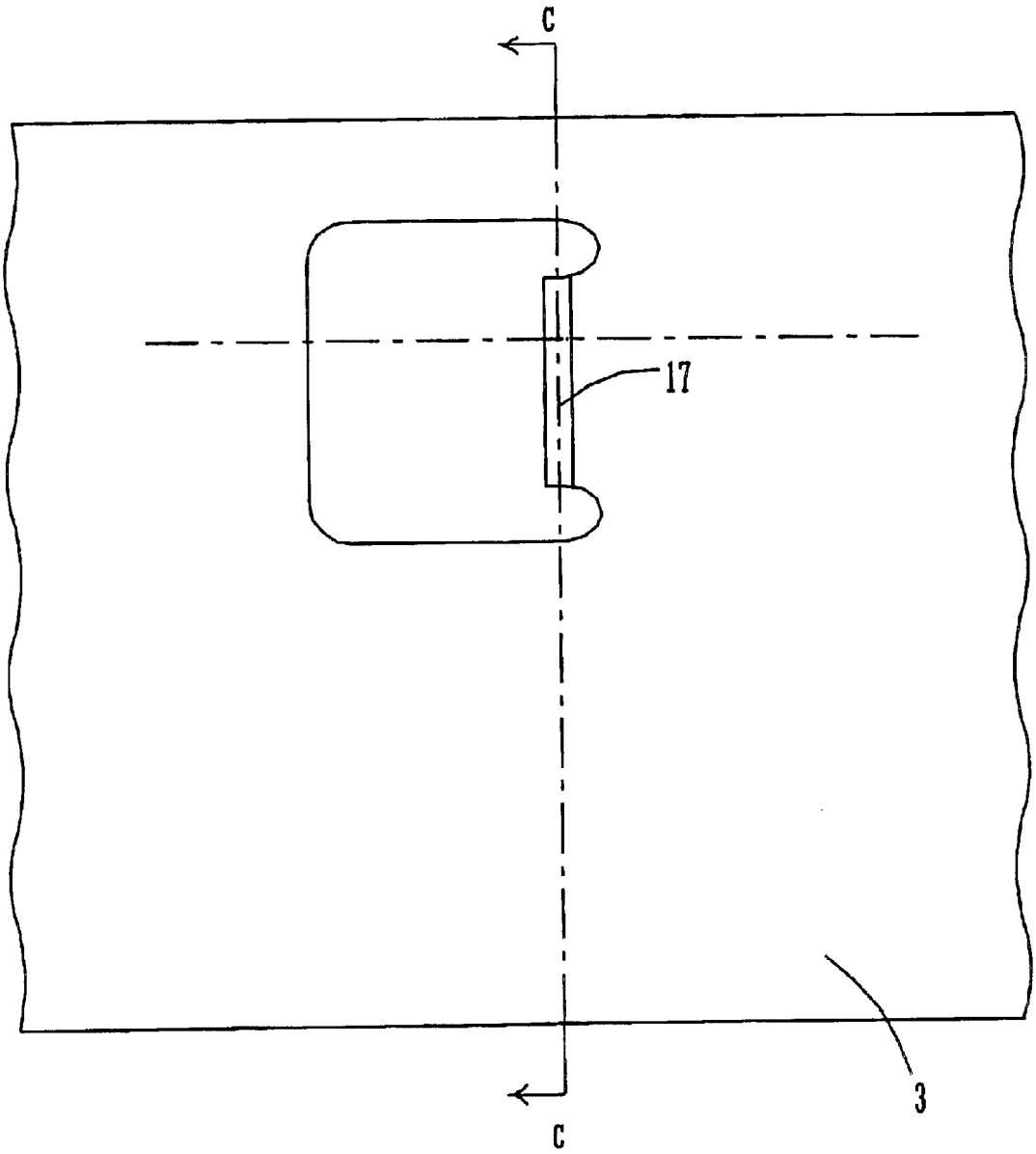
FIG. 18 is a fragmentary view showing a central swing-center support portion of an attachment plate, which is an example of the present invention.
Figure 19:
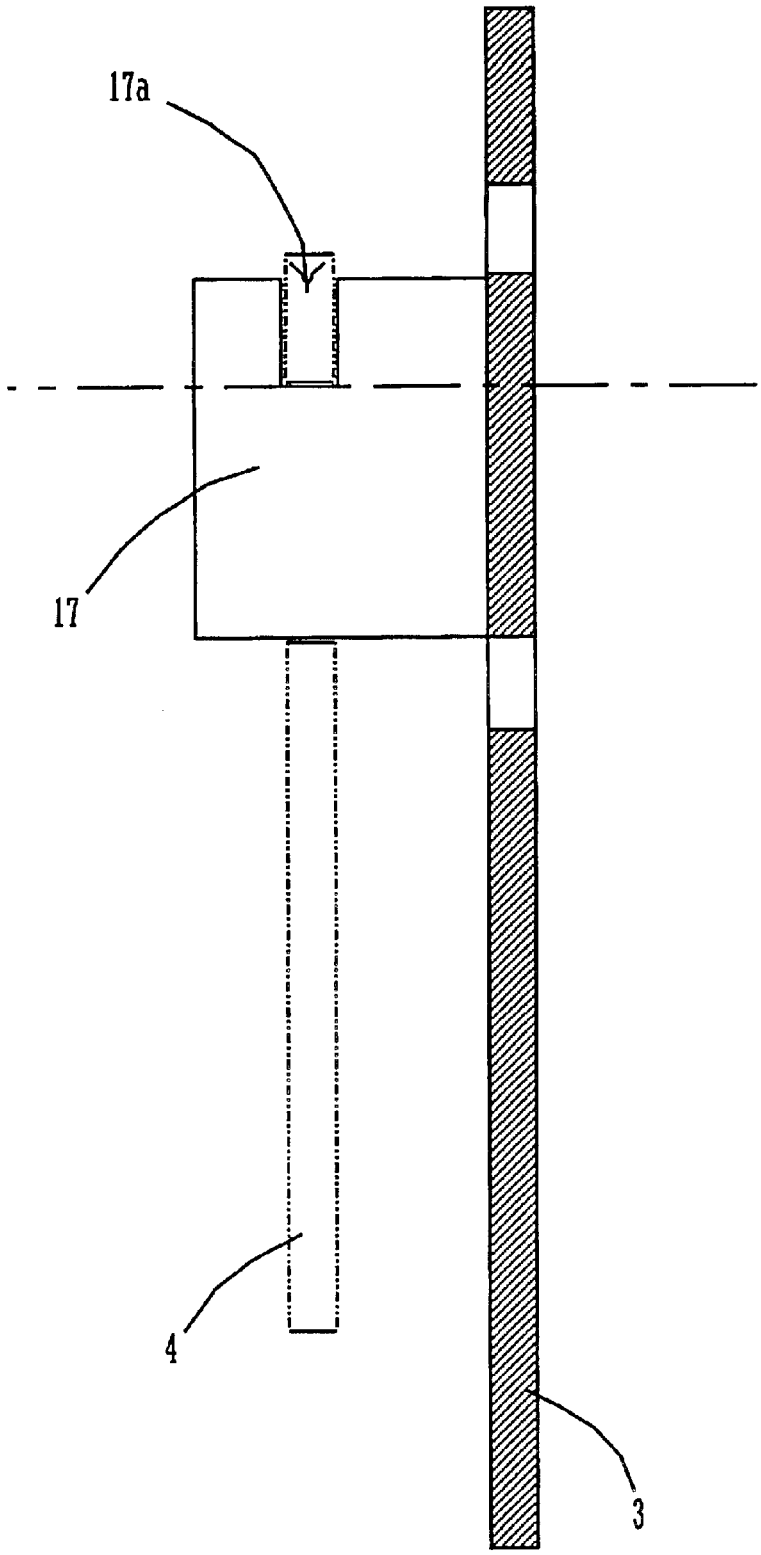
FIG. 19 is a cross sectional view taken on the line c—c of FIG. 18.
Figure 20:
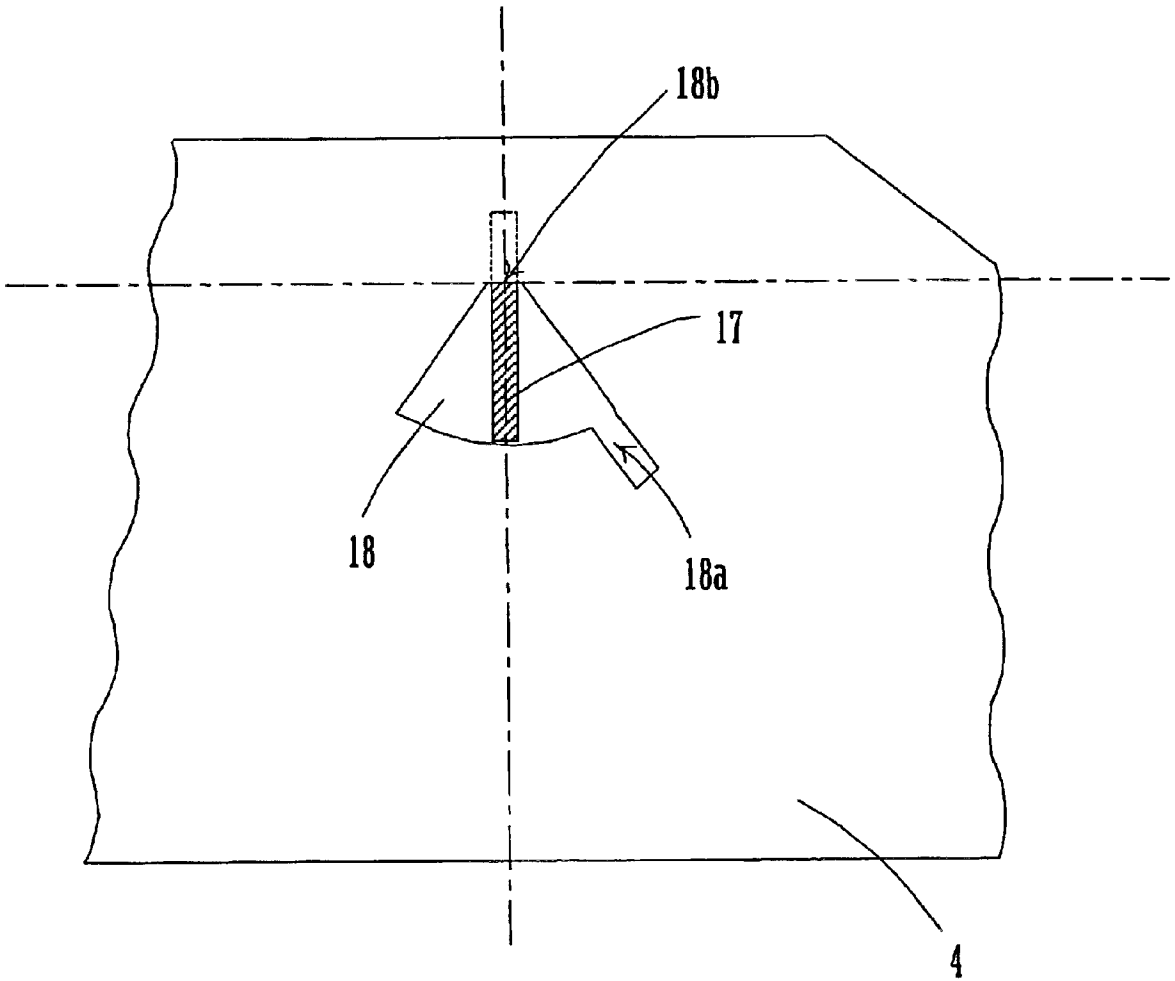
FIG. 20 is a cross sectional view showing the central swing-center support portion of FIG. 18.

Also, the central swing-center support portion 5 may take a shape shown in FIGS. 18 to 20. More particularly, there are formed: a vertical swing support plate 17 formed by bending a part of the attachment plate 3; a fan-shaped hole 18 that is positioned on an upper side of a central portion of the separating arm 4 and is smaller than a length of the swing support plate 17 with a head portion positioned on an upside for engaging the separating arm 4 with the swing support plate 17; an arresting slit 17*a* provided on the upper side of the swing support plate 17 for arresting lateral movement of the separating arm 4; and an insertion slit 18*a* provided on one end of the fan-shaped hole 18 toward a lower direction for inserting the swing support plate 17 into the fan-shaped hole 18 at a shifted angle in installing the separating arm 4 in the attachment plate 3.

After the swing support plate 17 is inserted into the insertion slit 18*a*, a head portion 18*b* of the fan-shaped hole 18 is fallen into the arresting slit 17*a* of the swing support plate 17, so that the fan-shaped hole 18 can be fit in a clearance-fit state with a narrow portion of the swing support plate 17, by which the separating arm 4 can be easily rotated in a reverse direction to restore a regular state. It is noted that FIG. 19 is a cross sectional view taken on the line c—c of FIG. 18. In the shape shown in FIGS. 15 to 17, the arresting slit 15*a* is positioned on the lower side of the fan-shaped hole 16, whereas in the shape shown in FIGS. 18 to 20, the arresting slit 17*a* is positioned on the upper side of the head portion 18*b* of the fan-shaped hole 18, which enables holding of the separating arm 4 in a more stable state.

As described above, according to the present invention, the following effects can be produced.

In the state where the separating arm is restrained from moving in a direction perpendicular to its thicknesswise direction by a lateral movement arresting portion of the central swing-center support portion, and where the sliding direction of the separating arm is guided by the first and second partial sliding contact portions in the anterior swing guide portion and the posterior swing guide portion on the front and lower rear sides of the central swing-center support portion, the separating arm is swingably supported on the attachment plate by a swing-center portion of the central swing-center support portion, which makes it possible to swingably hold the separating arm at three points in its longitudinal direction in a structurally stable state. Also, the separating arm is brought into contact with the first and second partial sliding contact portions of the anterior swing guide portion and the posterior swing guide portion with a small contact area, so that even if the separating arm or the attachment plate suffers warps generated in manufacturing process or suffers residual strain generated in installation process, it becomes possible to prevent excessive sliding resistance from acting upon the separating arm under swing operation.

This makes it possible to maintain a claw pressure of the corner pawl acting on the paper sheet, that is most influential to paper feeding and separating performance, to be a targeted value regardless of changes in the position of a top face of the paper sheet, to prevent paper feeding errors such as multiple pages being fed, a corner of paper being folded, and paper jam, and to implement paper feeding with higher reliability.

After the separating arm is rotated in the swing direction so that the plate axis extending at right angles from a part of the attachment plate is inserted into the central hole and the insertion slit of the separating arm, in a state that the insertion slit of the separating arm faces the arresting slit of the plate axis, the separating arm is reversely rotated in a swing direction while a portion in the periphery of the central hole facing the formation portion of the insertion slit is pressed against an end portion of the plate axis. In this arrangement, if a portion in the periphery of the central hole other than the formation portion of the insertion slit is so structured as to be fit with the arresting slit of the plate axis, then it becomes possible to easily align the center of the plate axis in its width direction at a position where the arresting slit is formed and the center of the hole of the separating arm as a swing-center of the separating arm when the separating arm is reversely rotated for installing the separating arm in the attachment plate. This makes it possible to simplify an operation of fitting a part of the separating arm into the arresting slit in a clearance-fit state.

After the separating arm is rotated in a swing direction so that the plate axis extending at right angles from a part of the attachment plate is inserted into the fan-shaped hole and the insertion slit of the separating arm, in a state that the insertion slit of the separating arm faces the arresting slit of the plate axis, the separating arm is reversely rotated in a swing direction while the head portion of the semicircular-shaped hole is supported by an upper end of the plate axis. In this arrangement, if a portion in the periphery of the partial circular arc of the fan-shaped hole other than the formation portion of the insertion slit is so structured as to be fit with the arresting slit of the plate axis, then it becomes possible to easily align the head portion of fan-shaped hole that is in contact with the upper end of the plate axis with a swing-center of the separating arm when the separating arm is reversely rotated for installing the separating arm in the attachment plate. This makes it possible to simplify an operation of fitting a part of the separating arm into the arresting slit in a clearance-fit state.

After the separating arm is rotated in a swing direction so that the plate axis extending at right angles from a part of the attachment plate is inserted into the fan-shaped hole and the insertion slit of the separating arm, the separating arm is moved downward along a formation direction of the insertion slit. In this arrangement, if the head portion of the fan-shaped hole is fit into the arresting slit of the plate axis so as to be supported by a bottom portion of the arresting slit as a swing-center of the separating arm, it becomes possible to simplify an operation of fitting a part of the separating arm into the arresting slit in a clearance-fit state in installing the separating arm in the attachment plate.

A swing center of the central swing-center support portion is disposed so that the corner pawl moves up and down in a generally vertical direction along with swing of the separating arm, which makes it possible to prevent the corner pawl from exerting an excess force on the uppermost paper sheet, and enables smooth action of a generally constant pressure to a top face of the uppermost paper sheet from the corner pawl, thereby ensuring separation of paper sheets in paper feeding operation. Also, it becomes possible to dispose a sliding center portion of the central swing-center support portion on relatively upper side of the separating arm, so that the distance between the central swing-center support portion and the posterior swing guide portion facing a rear lower end of the separating arm, which suppresses lost motions of the installed separating arm without the necessity of increasing manufacturing precision of the attachment plate and the separating arm, thus allowing the product precision to be improved.

What is claimed is:

1. A separating arm holding mechanism for use in a sheet feeder by which paper sheets are separated with a claw pressure exerted upon a top face of an uppermost sheet of paper by means of a corner pawl formed at one end of a plate-shaped separating arm, where the separating arm is supported swingably and substantially parallel to a plate-shaped attachment plate, the separating arm holding mechanism comprising:

a central swing-center support portion, an anterior swing guide portion, and a posterior swing guide portion, wherein the central swing-center support portion includes a swing center portion in which a plate axis extending from the attachment plate is inserted into a hole provided at an upper center portion of the separating arm, and a lateral movement arresting portion provided on the plate axis to regulate movement of the separating arm in a direction perpendicular to a thicknesswise direction of the separating arm, the anterior swing guide portion includes a first partial sliding contact portion for guiding a swing direction of the separating arm by an opening portion of a slit with expanded recess that is provided at a front portion of the attachment plate forward of the central swing-center support portion, and the posterior sliding guide portion includes a second partial sliding contact portion for guiding a swing direction of the separating arm by protrusions in contact with both sides of the separating arm provided on a lower rear side of the central swing-center support portion.

2. The separating arm holding mechanism as defined in claim 1, wherein the swing center portion comprises: a plate axis extending at right angles in a constant width from a part of the attachment plate; a hole having a diameter smaller than the width of the plate axis and formed on an upper central portion of the separating arm; and an insertion slit formed extending in an oblique direction onward from a periphery of the hole so that a portion of the plate axis larger in width than the diameter of the hole is fit along a thicknesswise direction of the separating arm, and wherein the lateral movement arresting portion is an arresting slit that is provided on one side of the plate axis so that a portion in a periphery of the hole other than a portion at which the insertion slit is formed is fit along a swing direction of the separating arm.

3. The separating arm holding mechanism as defined in claim 1, wherein the swing-center portion comprises: a swing support plate extending at right angles in a constant width from a part of the attachment plate; a fan-shaped hole that includes a partial circular arc whose radius is smaller than a width of the sliding support plate and that is formed on an upper side of a central portion of the separating arm with a head portion positioned on an upside; and an insertion slit formed so as to extend in an oblique direction onward from a periphery of the partial circular arc of the fan-shaped hole so that a portion of the sliding support plate larger in width than a radius of the fan-shaped hole is fit along a thicknesswise direction of the separating arm, and wherein the lateral movement arresting portion is an arresting slit that is formed at a lower end of the sliding support plate in an opened state so that a portion in a periphery of the partial circular arc of the fan-shaped hole other than a portion at which the insertion slit is formed is fit along a sliding direction of the separating arm.

4. The separating arm holding mechanism as defined in claim 1, wherein the swing center portion comprises: a swing support plate extending at right angles in a constant width from a part of the attachment plate; a fan-shaped hole that includes a partial circular arc whose radius is smaller than a width of the sliding support plate and that is formed on an upper side of a central portion of the separating arm with a head portion positioned on an upside; and an insertion slit formed so as to extend in an oblique direction onward from a periphery of the partial circular arc of the fan-shaped hole so that a portion of the sliding support plate larger in width than a radius of the fan-shaped hole is fit along a thicknesswise direction of the separating arm, and wherein the lateral movement arresting portion is an arresting slit that is formed at an upper end of the sliding support plate in an opened state so that the head portion of the fan-shaped hole is fit along a direction in which the insertion slit is formed.

5. The separating arm holding mechanism as defined in claim 1, wherein the swing center portion of the central swing-center support portion is positioned so that a tangent line of a track of the corner pawl drawn by swing of the separating arm in the state that the separating arm is in an uppermost position in a swing range of the separating arm is substantially coincident with a plumb line, and the posterior swing guide portion is formed in a position facing a vicinity of a rear lower end of the separating arm.

* * * * *